US009752735B2

(12) United States Patent
Chamberlain

(10) Patent No.: US 9,752,735 B2
(45) Date of Patent: Sep. 5, 2017

(54) OPTICALLY AND THERMALLY EFFICIENT HIGH BAY LIGHT FIXTURE

(71) Applicant: LINMORE LED LABS, INC., Las Vegas, NV (US)

(72) Inventor: Paul Chamberlain, Las Vegas, NV (US)

(73) Assignee: Linmore LED Labs, Inc., Las Vegas, NV (US)

( * ) Notice: Subject to any disclaimer, the term of this patent is extended or adjusted under 35 U.S.C. 154(b) by 0 days.

(21) Appl. No.: 15/238,125

(22) Filed: Aug. 16, 2016

(65) Prior Publication Data

US 2017/0051881 A1 Feb. 23, 2017

Related U.S. Application Data

(60) Provisional application No. 62/208,414, filed on Aug. 21, 2015.

(51) Int. Cl.
*F21S 8/04* (2006.01)
*F21K 9/275* (2016.01)
(Continued)

(52) U.S. Cl.
CPC ..... *F21K 9/275* (2016.08); *F21K 9/272* (2016.08); *F21S 8/04* (2013.01); *F21V 3/02* (2013.01);
(Continued)

(58) Field of Classification Search
CPC . F21K 9/275; F21K 9/272; F21V 3/02; F21V 15/015; F21V 7/06; F21V 29/74; F21V 29/83; F21S 8/04
See application file for complete search history.

(56) References Cited

U.S. PATENT DOCUMENTS 8,220,953 B1 * 7/2012 Moore ..... F21S 8/04 362/217.01
8,297,788 B2 10/2012 Bishop
(Continued)

OTHER PUBLICATIONS

General Electric "Albeo LED Luminaire." 8 pages. Jun. 11, 2015. www.gelighting.com.
(Continued)

*Primary Examiner* — Thomas M Sember
(74) *Attorney, Agent, or Firm* — Stetina Brunda Garred and Brucker; Mark B. Garred

(57) ABSTRACT

A heat dissipating and optically efficient LED high bay light bar which may be used as part of a complete retrofit system for a variety of linear fluorescent light fixtures. The LED high bay light bar comprises an elongate channel member which is preferably fabricated from extruded aluminum. In addition to the channel member, the LED high bay light bar comprises a high-efficacy set of LEDs, which are preferably provided in the form of an elongate LED printed circuit board (PCB) or strip mechanically bonded to the channel member. The channel member is outfitted with fins and other surface features uniquely configured to provide superior heat dissipation, thus allowing the channel member to effectively function as a heat sink for the LED strip cooperatively engaged thereto. The channel member is configured to define an air flow cavity under the LED strip as allows for the effective dissipation of heat during operation of the LED light bar. The channel member also includes a parabolic reflector portion which is itself uniquely configured to provide optimal light emission/distribution characteristics.

20 Claims, 14 Drawing Sheets

(51) Int. Cl.

| | |
|---|---|
| ***F21V 3/02*** | (2006.01) |
| ***F21K 9/272*** | (2016.01) |
| ***F21V 15/015*** | (2006.01) |
| ***F21V 7/06*** | (2006.01) |
| ***F21V 29/74*** | (2015.01) |
| ***F21V 29/83*** | (2015.01) |
| *F21Y 115/10* | (2016.01) |
| *F21Y 103/10* | (2016.01) |

(52) U.S. Cl.
CPC ..... *F21V 7/06* (2013.01); *F21V 15/015* (2013.01); *F21V 29/74* (2015.01); *F21V 29/83* (2015.01); *F21Y 2103/10* (2016.08); *F21Y 2115/10* (2016.08)

(56) References Cited

U.S. PATENT DOCUMENTS

| | | | | |
|---|---|---|---|---|
| 2013/0170197 | A1 | 7/2013 | Bishop | |
| 2014/0119000 | A1 | 5/2014 | Zhang et al. | |
| 2014/0355272 | A1 * | 12/2014 | Chou ..... | F21S 4/008 362/308 |

OTHER PUBLICATIONS

MaxLite "Baymax LED Linear Highbay Fixture." 4 pages. Jul. 21, 2015. www.maxlite.com.
Deco Lighting "Deco Digital." 3 pages. 2014. www.getdeco.com.

* cited by examiner

OPTICALLY AND THERMALLY EFFICIENT HIGH BAY LIGHT FIXTURE

CROSS-REFERENCE TO RELATED APPLICATIONS

The present application claims priority to U.S. Provisional Application Ser. No. 62/208,414 entitled OPTICALLY AND THERMALLY EFFICIENT HIGH BAY LIGHT FIXTURE Aug. 21, 2015.

STATEMENT RE: FEDERALLY SPONSORED RESEARCH/DEVELOPMENT

Not Applicable

BACKGROUND

1. Field of the Invention

The present disclosure relates generally to lighting systems and, in a first embodiment, to an LED light bar which is uniquely configured to provide superior heat dissipation characteristics while further being adapted for retrofit applications in substitution for any one of a variety of linear fluorescent light fixtures and, in a second embodiment, an LED high bay light fixture which is uniquely configured to provide superior heat dissipation and light emission/distribution characteristics while further being adapted for retrofit applications in substitution for any one of a variety of conventional linear fluorescent and non-LED light fixtures.

2. Description of the Related Art

The use of LED (Light Emitting Diode) lights is becoming increasingly popular in a wide variety of lighting applications. Significant advances have been made in LED lighting technology, which has made the use of LED lights more affordable and desirable in various industrial, household, and other environments requiring expanded lighting systems.

LED lights are generally viewed as offering significant advantages over traditional incandescent lighting systems. With incandescent bulbs, the expense is not only the cost of replacement bulbs, but the labor and costs associated with frequent replacement of the bulbs. This expense can be significant where there are a large number of installed bulbs. For example, the high maintenance costs typically incurred to replace bulbs in large office buildings, commercial warehouses, and the like are substantially minimized with LED lighting systems. In addition, the operational life of conventional white LED lamps is about 100,000 hours, which is a drastic increase over the average life of an incandescent bulb, which is approximately 5000 hours. Thus, the use of LED lights virtually eliminates the need for routine bulb replacement, this advantage being even more important when the lighting device is embedded or located in a relatively inaccessible place. Still further, it is generally recognized that, in a properly designed system, LED lights consume significantly less power than incandescent bulbs. In greater detail, an LED circuit has an efficiency of about 80%, meaning that about 80% of the electrical energy is converted to light energy, while the remaining 20% is lost as heat energy. As will be recognized, this efficiency facilitates significant cost savings in large lighting systems.

However, due in part to the relatively high cost of LED lights, the art turned to fluorescent light bulbs and systems as an alternative to incandescent lights. Generally speaking, fluorescent lighting is significantly less costly than incandescent lighting while providing essentially the same brightness, and also lasts longer than conventional incandescent lighting, in greater detail, on average, a fluorescent tube has a lifespan of about six times longer than a regular incandescent bulb. Because of these advantages, a vast majority of commercial and industrial structures incorporate conventional fluorescent light bar fixtures.

Fluorescent lights, however, have distinct disadvantages which detract from their overall utility. In greater detail, fluorescent lighting circuits are more complex than incandescent lighting and generally require professional installation and expensive components. In addition, fluorescent lighting is generally less attractive than incandescent lighting and can flicker noticeably, while also producing an uneven light. Mercury is also an essential component in the manufacturing of fluorescent light tubes, and is considered hazardous by the U.S. Environmental Protection Agency due to its ability to bio-accumulate within the environment. Along these lines, the disposal of fluorescent light tubes is problematic for many municipalities.

The aforementioned drawbacks associated with the use fluorescent lighting have resulted in an increased reliance on LED lighting, with the use LED light bars as an alternative to fluorescent light tubes becoming more prevalent as the costs of LED lighting continue to decrease in the marketplace. However, the cost of replacing existing fluorescent light tube fixtures and circuitry in existing structures, systems, and so forth, is still relatively high. These costs are sometimes escalated by the designs of known LED lighting bars not being well suited for quick and easy retrofit installation, and further not being adapted for optimal heat dissipation and/or optimal light emission/distribution. These deficiencies as they relate to heat dissipation may result in the need to provide ancillary modalities to facilitate adequate heat dissipation. These deficiencies as they relate to light emission/distribution are particularly prevalent in "high bay" applications such as commercial warehouses wherein the floor to light fixture separation distance is twenty (20) feet or more. Thus, there is thus a need for an LED lighting system including an LED light bar that can easily and affordably be used in retrofit applications in substitution for conventional fluorescent light fixtures, and is provided with superior heat dissipation structural features, as well as superior light emission/distribution structural features as optimizes its utility for use in high bay applications. These, as well as other features and advantages are provided by the present disclosure as will be described in more detail below.

BRIEF SUMMARY

In accordance with the present disclosure, in a first embodiment, there is provided a heat dissipating LED light bar which may be used as part of a complete retrofit system for a variety of linear fluorescent light fixtures. It is contemplated that the LED light bar of the first embodiment may be provided in one of several nominal lengths (e.g., about 21 inches and about 45 inches) to retrofit the most popularly installed fluorescent light fixtures. The LED light bar comprises, among other things, an elongate channel member which is preferably fabricated from extruded aluminum (e.g., 6063 T5 aluminum). In addition to the channel member, the LED light bar comprises a high-efficacy set of LEDs, which are preferably provided in the form of an elongate LED printed circuit board (PCB) or strip. In greater detail, the LED strip preferably comprises an aluminum core which is mechanically bonded to the channel member, and has a multiplicity of LEDs (e.g., from 144 to 288) disposed thereon in a prescribed pattern or arrangement (e.g., two side-by-side rows).

The LED light bar further comprises an integral volumetric diffuser which is coupled to the channel member and effectively covers or shields the LED strip. The volumetric diffuser is adapted to eliminate glare and evenly distribute light, transmitting about 95% of the generated lumens from the LED strip, with the beam angle generated by the LED light bar being about 180° for a wide distribution of light. The LED light bar is further glass free based on the preferred material for the diffuser. The LED light bar further preferably comprises an external dimmable driver which electrically communicates with the LED strip.

The channel member of the LED light bar is outfitted with fins and other surface features uniquely configured to provide superior heat dissipation, thus allowing the channel member to effectively function as a heat sink for the LED strip cooperatively engaged thereto. Along these lines, the channel member is configured to provide or define an air flow cavity under the LED strip as allows for the effective dissipation of heat during operation of the LED light bar. The preferred mechanical bonding of the interior LED strip to the channel member maximizes the efficacy or functionality of the channel member as a heat sink. The LED light bar is further preferably outfitted with an identically pair of end caps which are cooperatively engaged to respective ones of the opposed ends of the channel member. The end caps are configured to provide open fluid communication between the air flow cavity and ambient air, and are further each outfitted with suitable modalities to facilitate the retrofit attachment of the LED light bar to an underlying support surface.

In a second embodiment, there is provided a heat dissipating LED high bay light bar which may also be used as part of a complete retrofit system for a variety of linear fluorescent light fixtures, as is particularly suited for high bay installation applications. The LED high bay light bar of the second embodiment comprises, among other things, an elongate channel member which is preferably fabricated from extruded aluminum (e.g., 6063 T5 aluminum). In addition to the channel member, the LED high bay light bar comprises a high-efficacy set of LEDs, which are preferably provided in the form of an elongate LED printed circuit board (PCB) or strip. In greater detail, the LED strip preferably comprises an aluminum core which is mechanically bonded to the channel member, and has a multiplicity of LEDs disposed thereon in a prescribed pattern or arrangement (e.g., two side-by-side rows). The channel member of the LED high bay light bar is outfitted with fins and other surface features uniquely configured to provide superior heat dissipation, thus allowing the channel member to effectively function as a heat sink for the LED strip cooperatively engaged thereto. Along these lines, the channel member is configured to provide or define an air flow cavity under the LED strip as allows for the effective dissipation of heat during operation of the LED high bay light bar. The preferred mechanical bonding of the interior LED strip to the channel member maximizes the efficacy or functionality of the channel member as a heat sink.

The channel member of the LED high bay light bar is further outfitted with a generally parabolic reflector portion which is itself uniquely configured to provide optimal light emission/distribution characteristics. In greater detail, reflector portion comprises two identically configured side sections which are integral portions of the channel member extending below the LED strip in spaced, opposed relation to each other. The structural features/contours of the reflector portion are designed to optimize the amount and consistency of distribution of the light emitted from the LED high bay light bar. In this regard, the objective of the design is to get as much light as possible directed downward based on fixture mounting heights starting at 20 feet. The distance the side sections are separated from each other, the parabolic shape of the reflector portion, the rate at which the side sections get farther apart as they extend downward, and how far the side sections extend downward are all optimized to achieve such objective. The light emitted is projected downward or is reflected off the interior surfaces of the side sections of the reflector portion. The curvature of the parabolic shaped side sections is further optimized to get light out of the reflector portion after only one bounce off of the reflector, as opposed to reflecting from one side section to the other side section, as each bounce of light decreases the light that is able to reach the work surface. It is contemplated that the interior, inwardly facing surfaces of the side sections will each have a sheet like insert applied thereto, these inserts each comprising a 98% reflective material to maximize the amount of light projected from the reflector portion. The distal edge of each of the side sections is formed to include an elongate slot, these slots extending in spaced, opposed relation to each other and accommodating the optional insertion of a diffuser material to reduce glare.

The LED high bay light bar is further preferably outfitted with an identically pair of end caps which are cooperatively engaged to respective ones of the opposed ends of the channel member. The end caps are configured to provide open fluid communication between the air flow cavity and ambient air, and are further each outfitted with suitable modalities to facilitate the retrofit attachment of the LED light bar to an underlying support surface.

The present disclosure is best understood by reference to the following detailed description when read in conjunction with the accompanying drawings.

BRIEF DESCRIPTION OF THE DRAWINGS

These, as well as other features of the present disclosure, will become more apparent upon reference to the drawings wherein.

Common reference numerals are used throughout the drawings and detailed description to indicate like elements.

DETAILED DESCRIPTION

Figure 1:
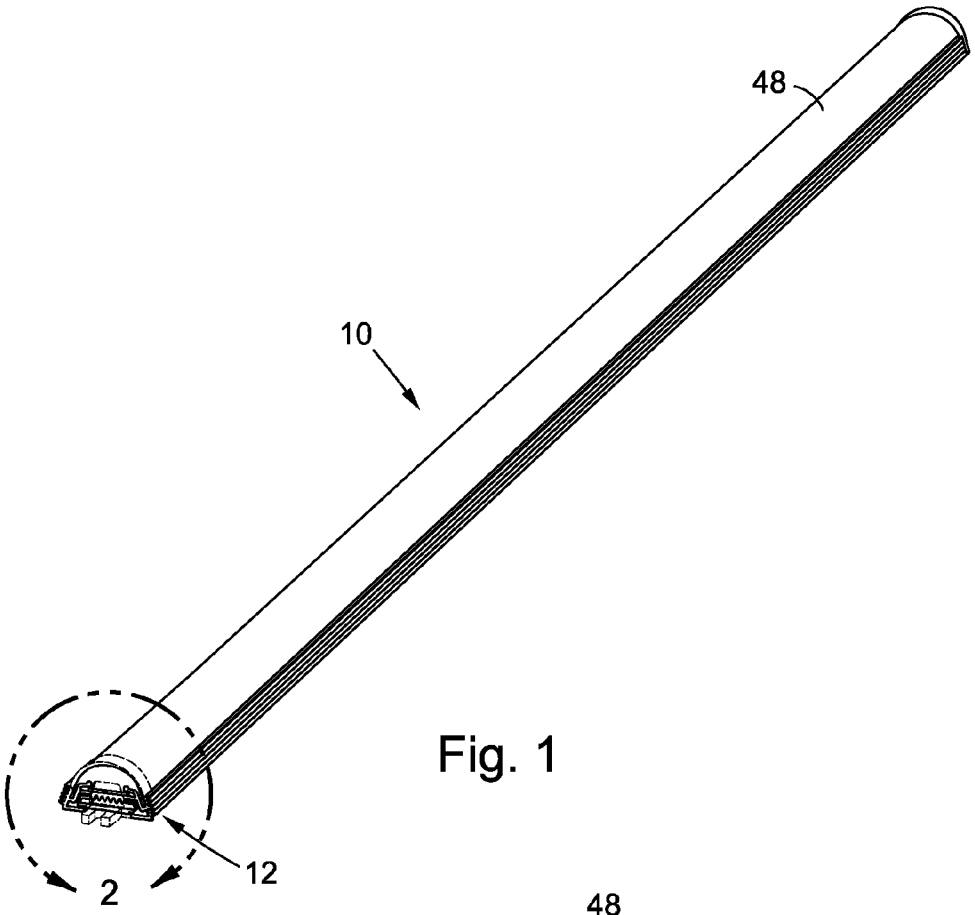
FIG. 1 is a top perspective view of an LED light bar constructed in accordance with a first embodiment of the present disclosure.
Figure 2:
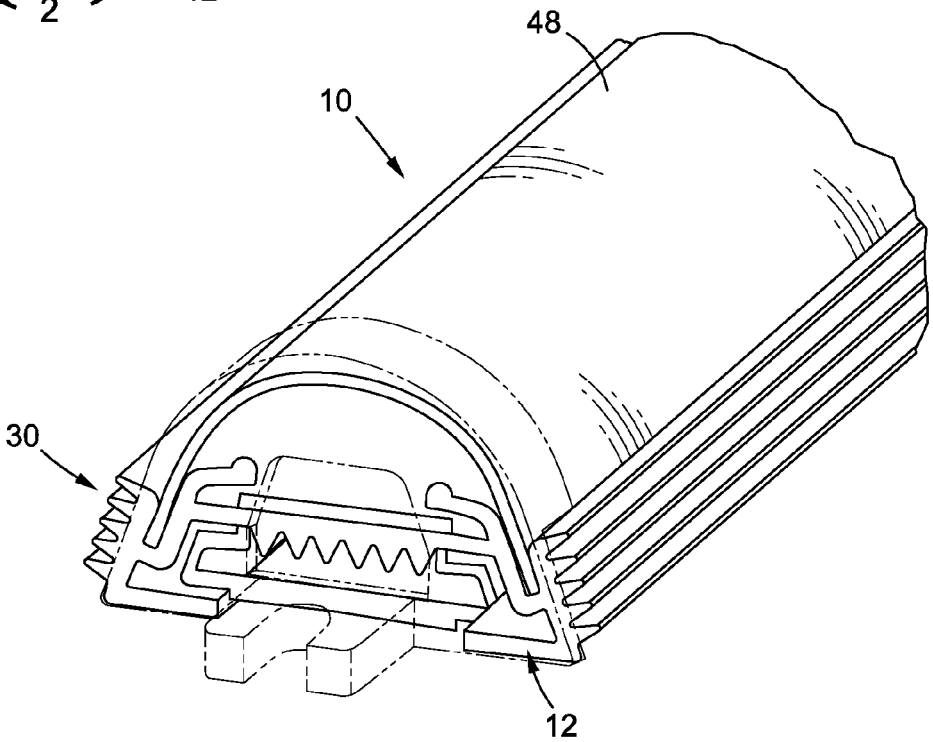
FIG. 2 is an enlargement of the encircled region 2 shown in FIG. 1.
Figure 3:
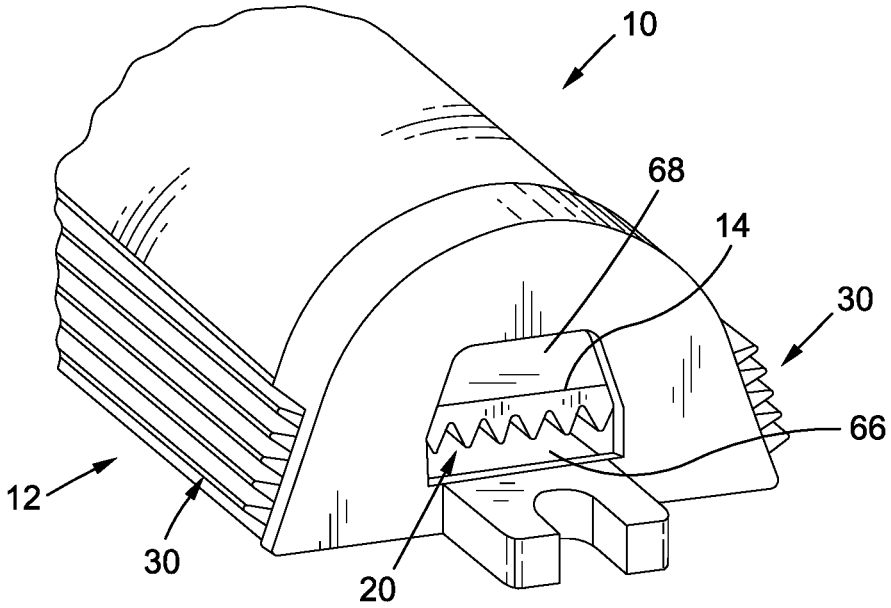
FIG. 3 is a further an enlargement of one end portion of the LED light bar shown in FIG. 1, but depicting one of the end caps of the opposed pair included therein in greater detail.
Figure 4:
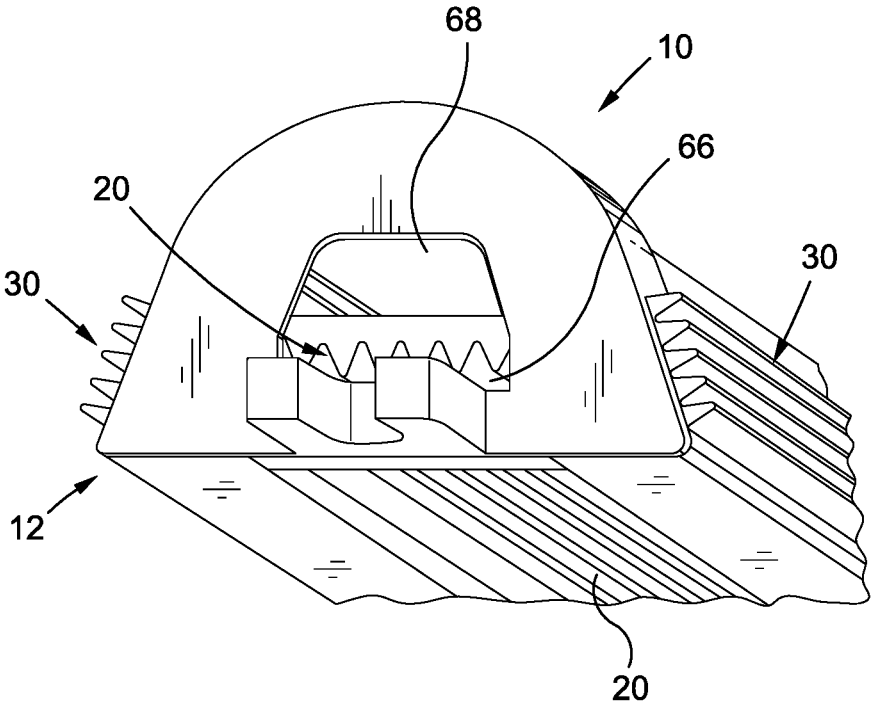
FIG. 4 is a bottom perspective view of the LED light bar shown in FIG. 3.

Referring now to the drawings for which the showings are for purposes of illustrating preferred embodiments of the present disclosure only, and not for purposes of limiting the same, FIGS. 1-6 depict an LED light bar 10 constructed in accordance with a first embodiment of the present disclosure. As indicated above, the LED light bar 10 may be used as part of a complete retrofit system for a variety of linear fluorescent light fixtures. In an exemplary embodiment of the present disclosure, the LED light bar 10 may be provided in one of several nominal lengths, e.g., about 21 inches and about 45 inches, to retrofit the most popularly installed fluorescent light fixtures. However, those of ordinary skill in the art will recognize that these length dimensions are exemplary only, and may be selectively increased or decreased without departing from the spirit and scope of the present disclosure.

Figure 7:
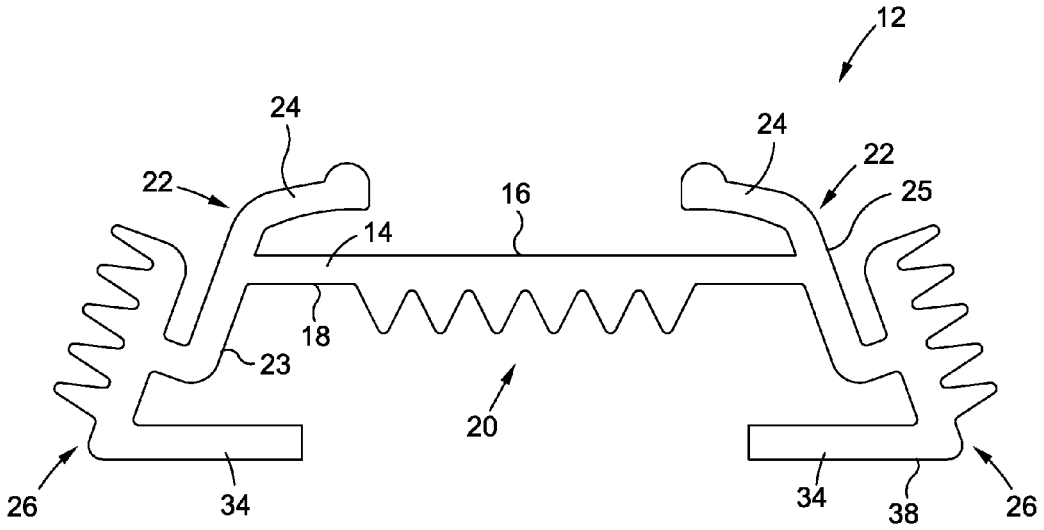
FIG. 7 is a cross-sectional view of the channel member of the LED light bar of the first embodiment as labeled with various preferred dimensional parameters.
Figure 8:
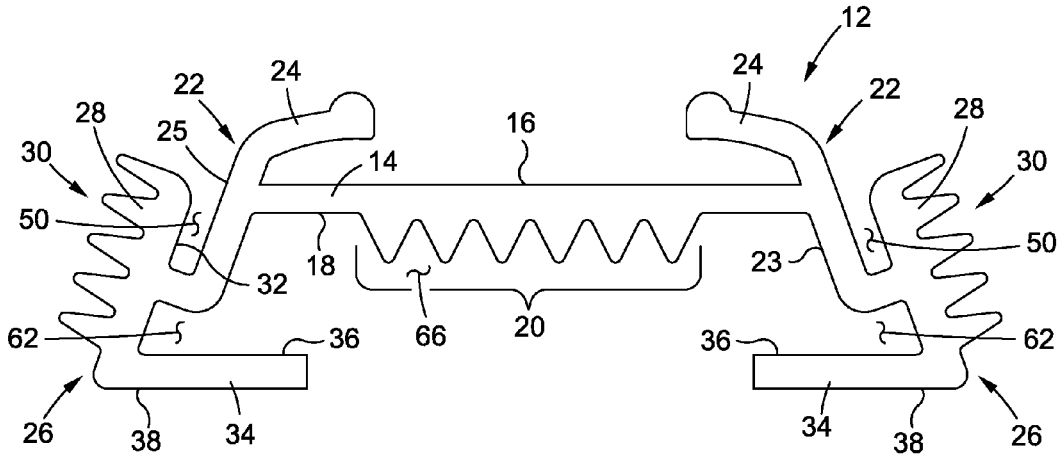
FIG. 8 is a cross-sectional view of the channel member of the LED light bar of the first embodiment similar to FIG. 7, but omitting the dimensional parameters.
Figure 9:
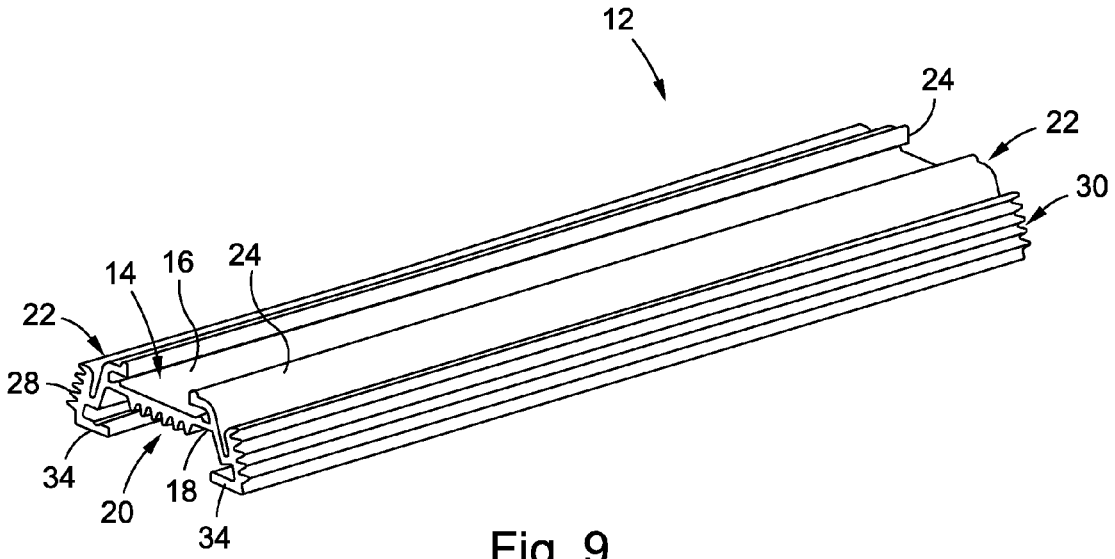
FIG. 9 is a top perspective view of the channel member of the LED light bar of the first embodiment.

One of the primary structural features of the LED light bar 10 is an elongate channel member 12, shown with particularity in FIGS. 7-9. The channel member 12 is preferably fabricated from extruded aluminum (e.g., 6063 T5 aluminum), though other materials may be used for the fabrication of the channel member 12 without departing from the spirit and scope of the present disclosure. In greater detail, the channel member 12 comprises an elongate support portion 14 which defines opposed longitudinal sides and, from the perspective shown in FIGS. 7 and 8, a generally planar first, top surface 16. In addition to the first surface 16, the support portion 14 defines a second, bottom surface 18 which extends in generally opposed relation to the first surface 16. As is most easily seen in FIGS. 7-9, the second surface 18, in contrast to the first surface 16, does not have a generally planar configuration. Rather, a central region 20 of the second surface 18 has a serrated configuration, defining a multiplicity of protrusions which each have a generally triangular or wedge-shaped cross-sectional profile. As will be recognized by those of ordinary skill in the art, due to the inclusion of the serrated central region 20 therein, the surface area defined by the second surface 18 substantially exceeds that defined by the opposed first surface 16 in the support portion 14 of the channel member 12.

In addition to the support portion 14, the channel member 12 includes an identically configured pair along of elongate flange portions 22 which are integrally connected to and extend along respective ones of the longitudinal sides of the support portion 14 in opposed relation to each other. As further seen in FIG. 8, each of the flange portions 22 defines an elongate coupling arm segment 24 which is angularly offset relative to the remainder thereof so as to overlap or overhang a portion of the first surface of the support portion 14. The remainder of each flange portion 22 not defined by the coupling arm segment 24 extends angularly relative to the support portion 14, and defines both an interior surface 23 and an opposed exterior surface 25. The opposed longitudinal sides of the support portion 14 extend to respective ones of the interior surfaces 23. From the perspective shown in FIGS. 7 and 8, that segment of each flange portion 22 which is not defined by the coupling arm segment 24 and extends below the support portion 14 is outwardly flared relative to the second surface 18. The use of the coupling arm segments 24 as defined by the flange portions 22 will be discussed in more detail below.

In addition to the support and flange portions 14, 22, the channel member 12 further comprises an identically configured pair of elongate rail portions 26 which are integrally connected to and extend along respective ones of the flange portions 22 in opposed relation to each other. As also seen in FIG. 8, each of the rail portions 26 defines a heat sink arm segment 28 having an exteriorly presented serrated surface 30 defining a multiplicity of protrusions which also each have a generally triangular or wedge-shaped cross-sectional profile. In addition to the exterior serrated surface 30, each heat sink arm segment 28 defines an opposed interior surface 32. In the channel member 12, each flange portion 22 transitions to the interior surface 32 of the heat sink arm segment 28 of a corresponding one of the rail portions 26. Similar to the support portion 14, the surface area defined by the exterior serrated surface 30 of each heat sink arm segment 28 substantially exceeds that of the opposed interior surface 32 thereof. In addition to the heat sink arm segment 28, each rail portion 26 defines a base arm segment 34 which is integrally connected and extends at a generally acute angle relative to the corresponding heat sink arm segment 28. Each base arm segment 34 defines a generally planar interior surface 36 which is directed toward or faces the second surface 18 of the support portion 14, and an opposed exterior surface 38 which also has a generally planar configuration.

Figure 5:
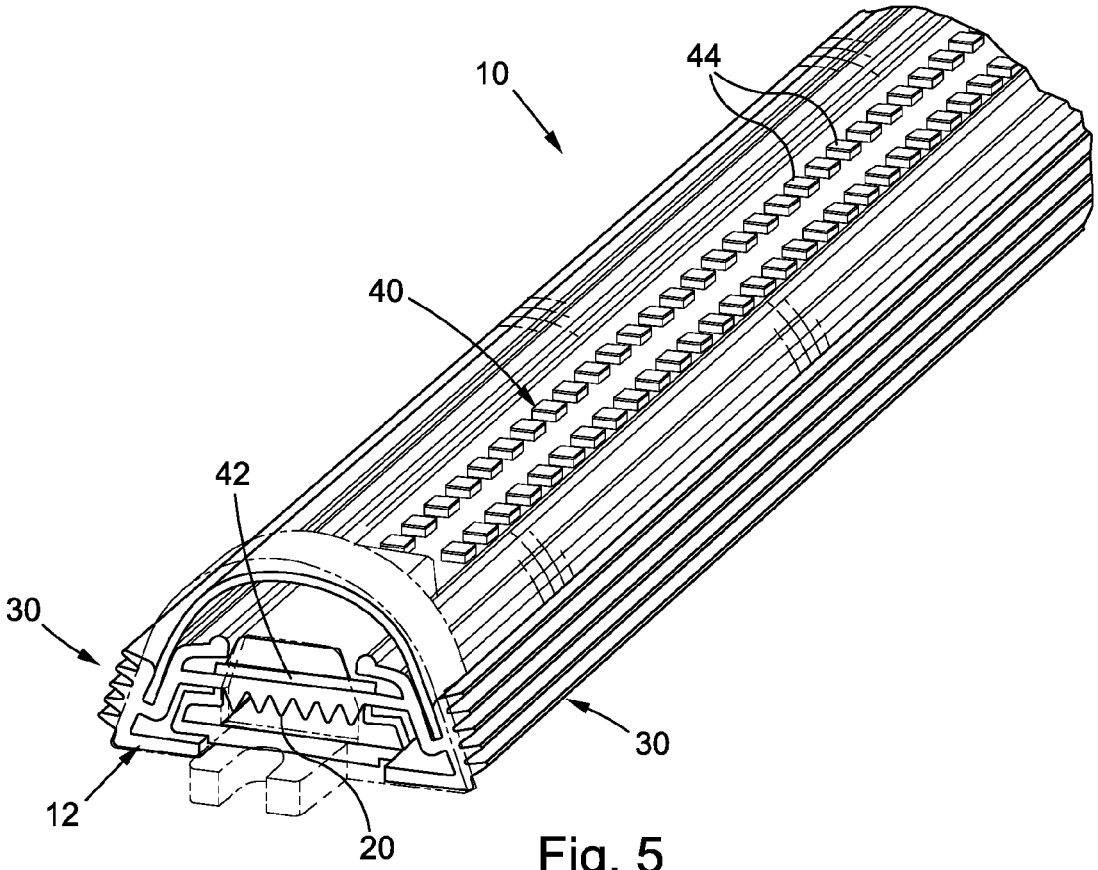
FIG. 5 is a top perspective view of the LED light bar of the first embodiment similar to FIG. 1, but with the diffuser removed for purposes of depicting the LED strip thereof.
Figure 6:
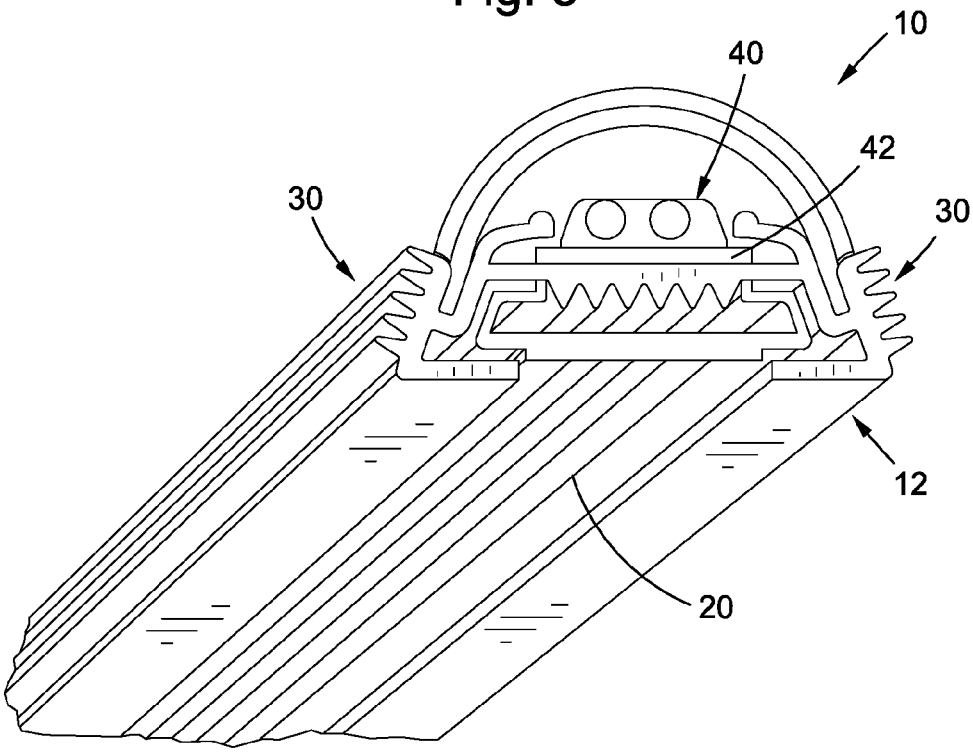
FIG. 6 is a is a bottom perspective view of the LED light bar of the first embodiment similar to FIG. 1, but with one of the end caps removed for purposes of depicting the LED strip thereof.

The LED light bar 10 further comprises an elongate LED strip 40 which is most easily seen in FIGS. 5 and 6. In the LED light bar 10, the LED strip 40 preferably comprises an elongate core 42 which has a strip-like configuration and, from the perspective shown in FIGS. 5 and 6, defines opposed, generally planar top and bottom surfaces. The core 42 is preferably fabricated from aluminum, though alternative materials may be used without departing from the spirit and scope of the present disclosure. Disposed on the top surface of the core 42 is a multiplicity of LEDs 44. The LEDs 44 are disposed on the top surface of the core 42 in a prescribed pattern or arrangement which, as shown in FIG. 5, comprises two side-by-side, generally parallel rows thereof. In an LED light bar 10 having a nominal length of about 21 inches, it is contemplated that the LED strip 40 thereof will be outfitted with about 144 LEDs 44. In an LED light bar 10 having a nominal length of about 45 inches it is contemplated that the LED strip 40 thereof will be outfitted with about 288 LEDs 44. However, those of ordinary skill in the art will recognize that the number and arrangement of LEDs 44 disposed on the top surface of the core 42 in the LED strip 40 integrated into the LED light bar 10 may also be varied from that described above without departing from the spirit and scope of the present disclosure.

In the LED light bar 10, it is contemplated that the LED strip 40, and in particular the core 42 thereof, will be mechanically bonded to the first surface 16 of the support portion 14 of the channel member 12. In greater detail, subsequent to the placement of the LED strip 40 upon the support portion 14 and extension of the LED strip 40 along the first surface 16 thereof, each of the coupling arm segments 24 of the flange portions 22 included in the channel member 12 will be bent slightly downwardly from the relative orientations shown in FIG. 8 so as to mechanically abut or engage the LED strip 40. In greater detail, the size and position of the LED strip 40 relative to the size and position of the coupling arm segments 24 results in the bent coupling arm segments 24 engaging corresponding portions of the top surface of the core 42 which extend along respective ones of the opposed longitudinally extending sides or edges thereof in the manner shown in FIG. 6. Thus, by virtue of the abutment of the coupling arm segments 24 of the flange portions 22 against the core 42, the LED strip 40 is effectively mechanically captured between the coupling arm segments 24 and the first surface 16 of the support portion 14. It is contemplated that the length of the LED strip 40, and in particular the core 42 thereof, will be substantially equal to that of the channel member 12, thus resulting in the opposed lateral ends of the core 42 terminating in a substantially flush or continuous relationship with respective ones of the opposed lateral ends of the support portion 14, and in particular the first surface 16 thereof (and hence respective ones of the opposed lateral ends of the channel member 12). When the LED strip 40 is cooperatively engaged to the support portion 14 of the channel member 12 in the aforementioned manner, the core 42 and LEDs 44 disposed thereon are in substantial alignment or registry with the serrated central portion 20 of the second surface 18 of the support portion 14.

Figure 10:
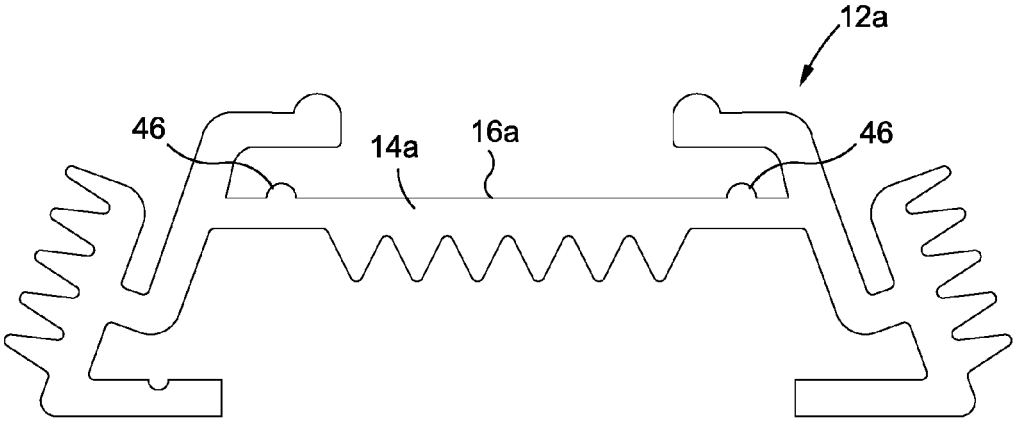
FIG. 10 is a cross-sectional view of alternative channel member which may be integrated into the LED light bar of the first embodiment as a minor structural variant of the channel member shown in FIGS. 7 and 8.

Referring now to FIG. 10, there is shown a channel member 12*a* which comprises a slight structural variant of the channel member 12, and may be integrated into the LED light bar 10 in substitution for the channel member 12. In greater detail, the sole distinction between the channel members 12, 12*a* lies in the support portion 14*a* of the channel member 12*a* being provided with an identically configured pair of elongate alignment ribs 46 formed on and extending longitudinally along the first surface 16*a* of the support portion 14*a* in spaced, generally parallel relation to each other. In the channel member 12*a*, the alignment ribs 46 are operative to maintain the LED strip 40 in a prescribed position on the first surface 14*a*, thus assisting in the prevention of any undesirable movement or shifting of the LED strip 40 during the process of bending the coupling arm segments 24 of the flange portions 22 to effectively engage the same.

The LED light bar 10 further comprises an integral volumetric diffuser 48 which is coupled to the channel member 12 and effectively covers or shields the LED strip 40. As seen in FIGS. 2-4 and 6, the diffuser 48 has an arcuate, arch-like configuration, and is sized to span the length of the channel member 12, with the opposed lateral ends of the diffuser 48 terminating in a substantially flush or continuous relationship with respective ones of the opposed lateral ends of the channel member 12. The cooperative engagement of the diffuser 48 to the channel member 12 is preferably facilitated by the advancement of the opposed longitudinally extending edge portions of the diffuser 48 into respective ones of a complementary pair of recesses 50 defined by the channel member 12.

As is best seen in FIG. 8, each recess 50 of the channel member 12 is collectively defined by the exterior surface 25 of a corresponding flange portion 22, and an opposed segment of the interior surface 32 of the heat sink arm segment 28 of the corresponding rail portion 26. The diffuser 48 is frictionally retained within the recesses 50. Such frictional retention may be attributable, in part, to an outward biasing force exerted by the diffuser 48 against the channel member 12, the diffuser 48 preferably having some measure of resiliency as allows the opposed longitudinally extending edge portions thereof to be slightly flexed toward each other as allows for their advancement into respective ones of the recesses 50. An exemplary diffuser 48 integrated into the LED light bar 10 is adapted to eliminate glare and evenly distribute light, transmitting about 95% of the generated lumens from the LED strip 40. In addition, the diffuser 48 is preferably configured such that the beam angle generated by the LED light bar 10 is about 180° for wide distribution of light.

Figure 11:
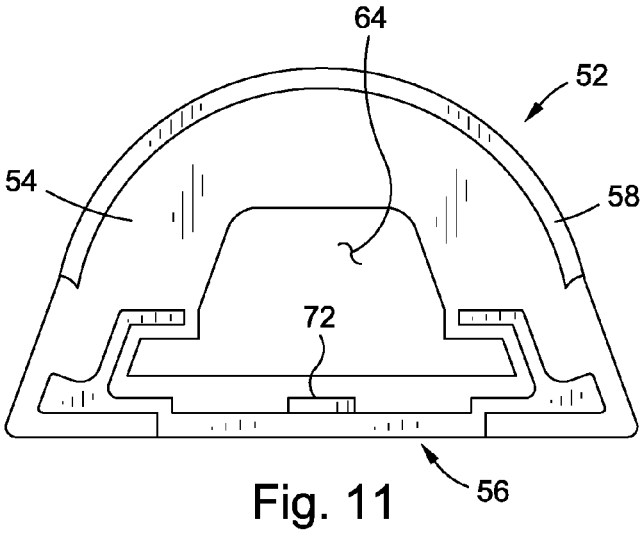
FIG. 11 is a front elevational view of one of the identically configured pair of end caps integrated into the LED light bar of the first embodiment.
Figure 12:
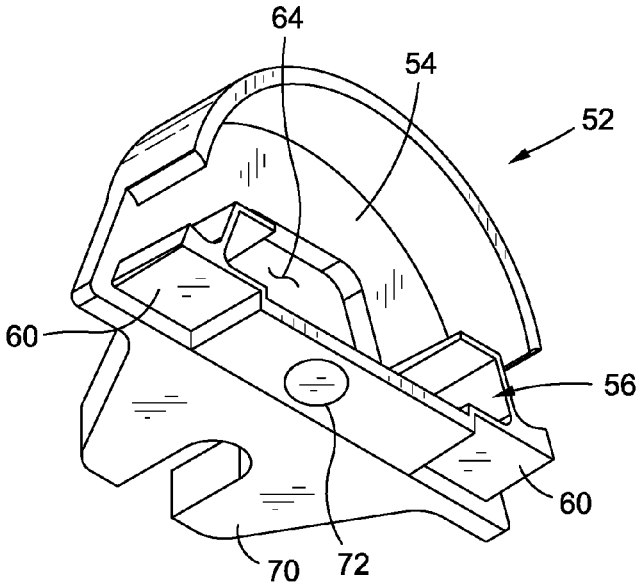
FIG. 12 is a bottom perspective view of the end cap shown in FIG. 11.
Figure 13:
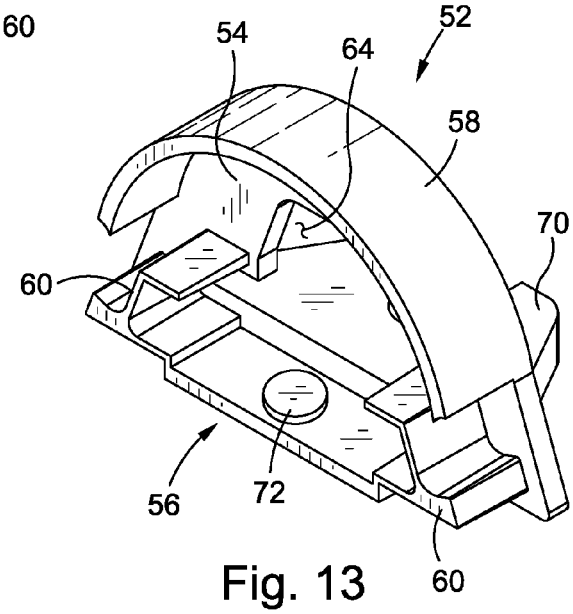
FIG. 13 is a top perspective view of the end cap shown in FIG. 11.

Referring now to FIGS. 11-13, the LED light bar 10 further comprises an identically configured pairs of end caps 52 which are cooperatively engaged to respective ones of the opposed lateral ends of the channel member 12. Generally speaking, each of the end caps 52, comprises an end wall portion 54 having a base portion 56 integrally formed on and extending along one peripheral side segment thereof, and an arcuate flange portion 58 integrally formed on and extending along another peripheral side segment thereof in generally opposed relation to the base portion 56. As seen in FIGS. 12 and 13, that segment of the base portion 56 protruding from the end wall portion 54 in the same direction as the flange portion 58 defines an opposed, identically configured pair of engagement tabs 60.

In the LED light bar 10, the engagement tabs 60 of each end cap 52 are sized and configured to be advanced into and frictionally maintained within respective ones of an opposed pair of recesses 62 which are also defined by the channel member 12. As seen in FIG. 8, each recess 62 is collectively defined by the interior surface 36 of the base arm segment 34 of a corresponding rail portion 26, a segment of the interior surface 32 of the heat sink arm segment 28 of that same rail portion 26, and a segment of the interior surface 23 of the corresponding flange portion 22. The advancement of the engagement tabs 60 into the complimentary recesses 62 is limited by the abutment of the corresponding lateral end of the channel member 12 against the end wall portion 54 of the corresponding end cap 52. As the advancement of the engagement tabs 60 of each end cap 52 into the recesses 62 occurs, the arcuate flange portion 58 of such end cap 52 is simultaneously advanced over a corresponding lateral end portion of the diffuser 48 which is preferably engaged to the channel member 12 prior to the attachment of the end caps 52 to each of the opposed ends thereof.

Each end cap 52 further defines an opening 64 within the end wall portion 54 thereof. When the end caps 52 are cooperatively engaged to the channel member 12, each opening 64 is aligned and fluidly communicates with an air flow cavity 66 of the channel member 12 which spans the length thereof, and is collectively defined by the second surface 18 of the support portion 14 (including the serrated central portion 20 of the second surface 18), the interior surfaces 23 of the flange portions 22, those segments of the interior surfaces 32 of the heat sink arm segments 28 of the rail portions 26 which do not partially define the recesses 50, and the interior surfaces 36 (as well as the inner ends) of the base arm segments 34 of the rail portions 26. Each opening 64 is further aligned and fluidly communicates with a cavity 68 of the LED light bar 10 which is collectively defined by portions of the channel member 12, and both the LED strip 40 and diffuser 48 attached to the channel member 12.

In addition to the engagement tabs 60, the base portion 56 of each end cap 52 defines a mounting tab 70 which protrudes from the end wall portion 54 in generally opposed relation to the engagement tabs 60, i.e., in a direction generally opposite the direction both the engagement tabs 60 and flange portion 58 protrude from the end wall portion 54. The mounting tabs 70 of the end caps 52 are uniquely configured to facilitate the retrofit attachment of the LED light bar 10 to an underlying support surface, such as a ceiling structure. In this regard, as best seen in FIGS. 12 and 13, each of the mounting tabs 70 defines a central recess which is adapted to accommodate a suitable fastener, such as a screw. It is also contemplated that the base portion 56 of each end cap 52 may optionally have a magnet 72 disposed therein. If included in each end cap 52, the magnets 72 assist in the installation of the LED light bar 10 by maintaining it in firm engagement to an underlying metallic surface prior to the advancement of fasteners through the mounting tabs 70.

When the LED light bar 10 is attached to an underlying support surface through the use of the mounting tabs 70 (alone or in combination with the magnets 72) of the end caps 52 thereof, it is contemplated that the exterior surfaces 38 of the base arm segments 34 will be abutted against such support surface. As such, with the LED light bar 10 being mounted to such support surface, the air flow cavity 66 is partially enclosed or bounded by the support surface itself which spans across the gap defined between the inner ends of the base arm segments 34.

During operation of the LED light bar 10, the heat generated by the activation of the LEDs 44 is effectively transferred to the core 42 of the LED strip 40. As a result of its direct contact with the first surface 16 of the support portion 14, the core 42 (which is also fabricated from aluminum as indicated above) in turn transfers the heat to the support portion 14 of the channel number 12. Heat transferred from the core 42 to the support portion 14 is in turn effectively dissipated into air within the air flow cavity 66, the heat transfer from the support portion 14 to the air flow cavity 66 being enhanced by the inclusion of the serrated central portion 20 of the second surface 18 which allows the support portion 14 to more effectively function as a heat sink. Heat transferred to the support portion 14 from the core 42 is further transferred to the rail portions 26 via respective ones of the intervening flange portions 22 which, as indicated above, are integrally connected to both the support portion 14 and the rail portions 26. Heat transferred to the rail portions 26 is effectively dissipated to ambient air by the serrated surfaces 30 of the heat sink arm segments 28. Thus, the support portion 14 (attributable to its inclusion of the serrated surface 30) and the rail portions 26 (attributable to their inclusion of the serrated surfaces 30 on the heat sink arm segments 28 thereof) effectively define three (3) separate heat sinks within the channel member 12 which allow for the efficient, effective dissipation of heat generated by the LEDs 44 of the LED strip 40. Heat is further dissipated into the open air within the aforementioned cavity 68, further enhancing the efficacy of the LED light bar 10 in dissipating heat. Along these lines, natural air circulation through the air flow cavity 66 and the cavity 68 as afforded by the openings 64 within the end caps 52 assists in the dissipation of heat from the LED light bar 10.

Referring now to FIGS. 14-20, there is shown an LED high bay light bar 100 constructed in accordance with a second embodiment of the present disclosure. As with the LED light bar 10 of the first embodiment, the LED high bay light bar 100 of the second embodiment may be used as part of a complete retrofit system for a variety of linear fluorescent light fixtures. Along these lines, for reasons which will be described in more detail below, the LED high bay light bar 100 of the second embodiment is particularly suited for use in high bay applications wherein it is separated from the ground by a distance of twenty (20) feet or more. In an exemplary embodiment of the present disclosure, the LED high bay light bar 100 may be provided in one of several nominal lengths and, as will also be described in more detail below, may be integrated in differing numbers and arrangements into a high bay chassis assembly.

One of the primary structural features of the LED high bay light bar 100 is an elongate channel member 112, shown with particularity in FIGS. 14-17. The channel member 112 is preferably fabricated from extruded aluminum (e.g., 6063 T5 aluminum), though other materials may be used for the fabrication of the channel member 112 without departing from the spirit and scope of the present disclosure. In greater detail, the channel member 112 comprises an elongate support portion 114 which defines opposed longitudinal sides and, from the perspective shown in FIGS. 16 and 17, a generally planar first, top surface 116. In addition to the first surface 116, the support portion 114 defines a second, bottom surface 118 which extends in generally opposed relation to the first surface 116. As is most easily seen in FIG. 17, the second surface 118, in contrast to the first surface 116, does not have a generally planar configuration. Rather, a central region 120 of the second surface 118 has a serrated configuration, defining a multiplicity of protrusions which each have a generally triangular or wedge-shaped cross-sectional profile. As will be recognized by those of ordinary skill in the art, due to the inclusion of the serrated central region 120 therein, the surface area defined by the second surface 118 substantially exceeds that defined by the opposed first surface 116 in the support portion 114 of the channel member 112.

In addition to the support portion 114, the channel member 112 includes an identically configured pair along of elongate coupling arm segments 124 which protrude angularly toward each other from the first surface 116 of the support portion 114 so as to overlap or overhang a portion of the first surface 116. The use of the coupling arm segments 124 will be discussed in more detail below.

In addition to the coupling arm segments 124, the channel member 112 comprises an identically configured pair of elongate rail portions 126 which are integrally connected to and extend along respective ones of the longitudinal sides of the support portion 114 in opposed relation to each other. From the perspective shown in FIGS. 16 and 17, each rail portion 126 extends below the support portion 114 and is outwardly flared relative to the second surface 118. Each of the rail portions 126 defines a heat sink arm segment 128 having an exteriorly presented serrated surface 130 defining a multiplicity of protrusions which also each have a generally triangular or wedge-shaped cross-sectional profile. In addition to the exterior serrated surface 130, each heat sink arm segment 128 defines an opposed interior surface 132, the opposed longitudinal sides of the support portion 114 extending to respective ones of the interior surfaces 132. Similar to the support portion 114, the surface area defined by the exterior serrated surface 130 of each heat sink arm segment 128 substantially exceeds that of the opposed interior surface 132 thereof. In addition to the heat sink arm segment 128, each rail portion 126 defines a base arm segment 134 which is integrally connected and extends at a generally acute angle relative to the corresponding heat sink arm segment 128. Each base arm segment 134 defines a generally planar interior surface 136 which is directed toward or faces the second surface 118 of the support portion 114, and an opposed exterior surface 138 which also has a generally planar configuration.

Figure 16:
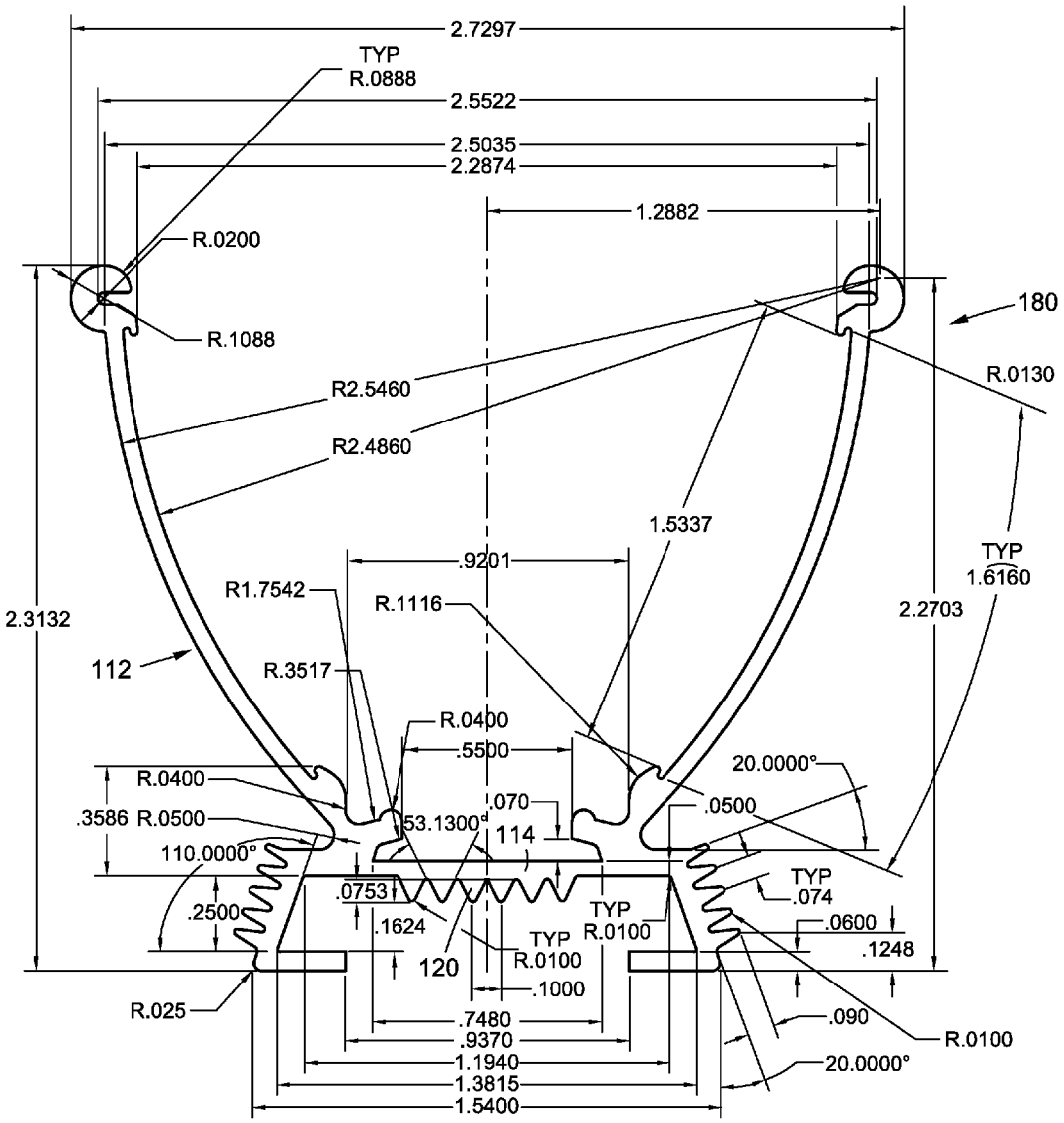
FIG. 16 is a cross-sectional view of the channel member of the LED high bay light bar of the second embodiment, as labeled with various preferred dimensional parameters.
Figure 17:
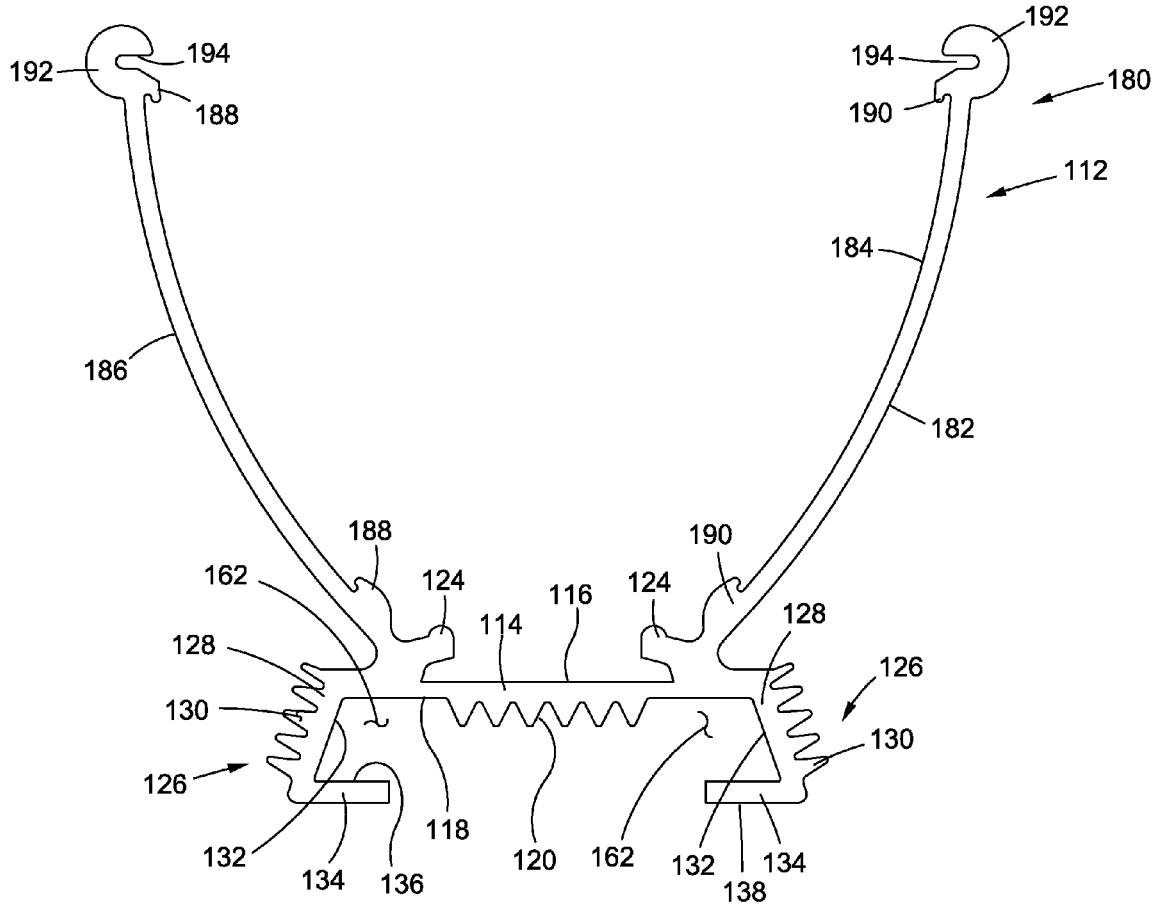
FIG. 17 is a cross-sectional view of the channel member of the LED high bay light bar of the second embodiment similar to FIG. 16, but omitting the dimensional parameters.

The channel member 112 further comprises a generally parabolic reflector portion 180. As seen in FIGS. 16 and 17, the reflector portion 180 comprises an identically configured pair of arcuate side sections 182, each of which defines a generally concave interior surface 184 and a generally convex exterior surface 186. The side sections are 182 integrally connected to the to the support portion 114 so as to protrude from the first surface 116 in spaced, opposed relation to each other. In the channel member 112, each the coupling arm segments 124 is proximate and extends inwardly relative to the interior surface 184 of a respective one of the side sections 182.

In the reflector portion 180, the interior surface 184 of each of the side sections 182 includes a pair retentions tabs 188 protruding therefrom in spaced relation to each other. The retention tabs 188 of each pair are integrally connected to the remainder of the corresponding side section 182, with one of these retention tabs 188 being disposed proximate and extending along the length of the distal edge of the corresponding side section 182, and the remaining retention tab 188 of the same pair being disposed proximate and extending along the length of a respective one of the coupling arm segments 124. Each retention tab 188 and a portion of the interior surface 184 of the corresponding side section 182 collectively define an elongate retention slot 190, with the retention slots 190 of each pair defined by one of the side sections 182 facing each other. The use of the retention slots 190 will be described in more detail below.

Each side section 182 of the reflector portion 180 further includes an attachment hub 192 integrally connected to an extending along the length of the distal edge thereof. The attachment hubs 192 each have a generally circular cross-sectional configuration, and extend in spaced, generally parallel relation to each other in the manner best shown in FIG. 17. In addition, each of the attachment hubs 192 defines an elongate attachment slot 194 which extends along the length thereof, the attachment slots 194 being proximate respective ones of the distal-most retention tabs 188 of the corresponding pair, and facing inwardly toward each other in the manner also shown in FIG. 17. The use of the attachments slots 194 will be described in more detail below.

Figure 14:
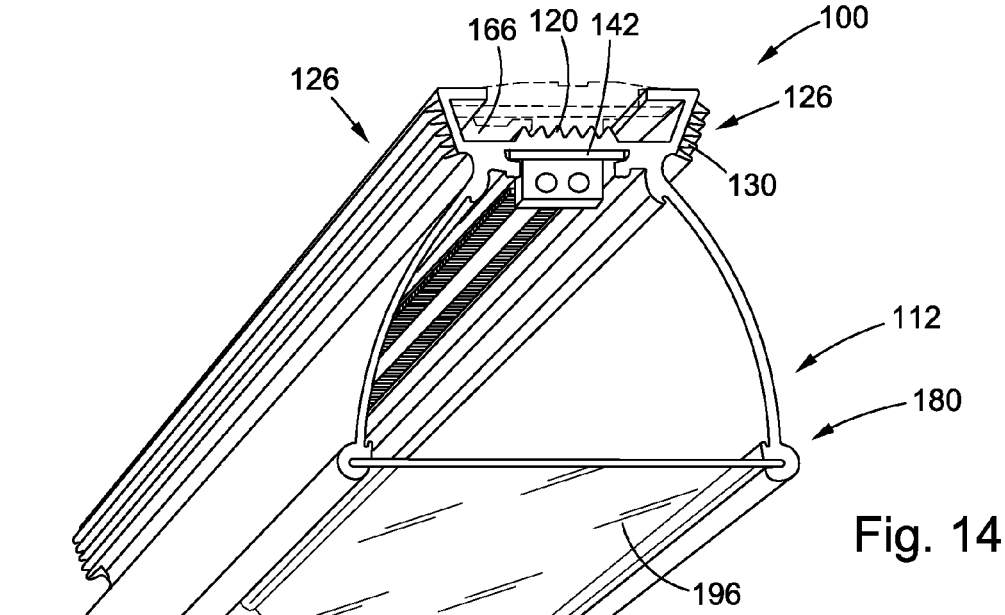
FIG. 14 is a bottom perspective view of an LED high bay light bar constructed in accordance with a second embodiment of the present disclosure.
Figure 15:
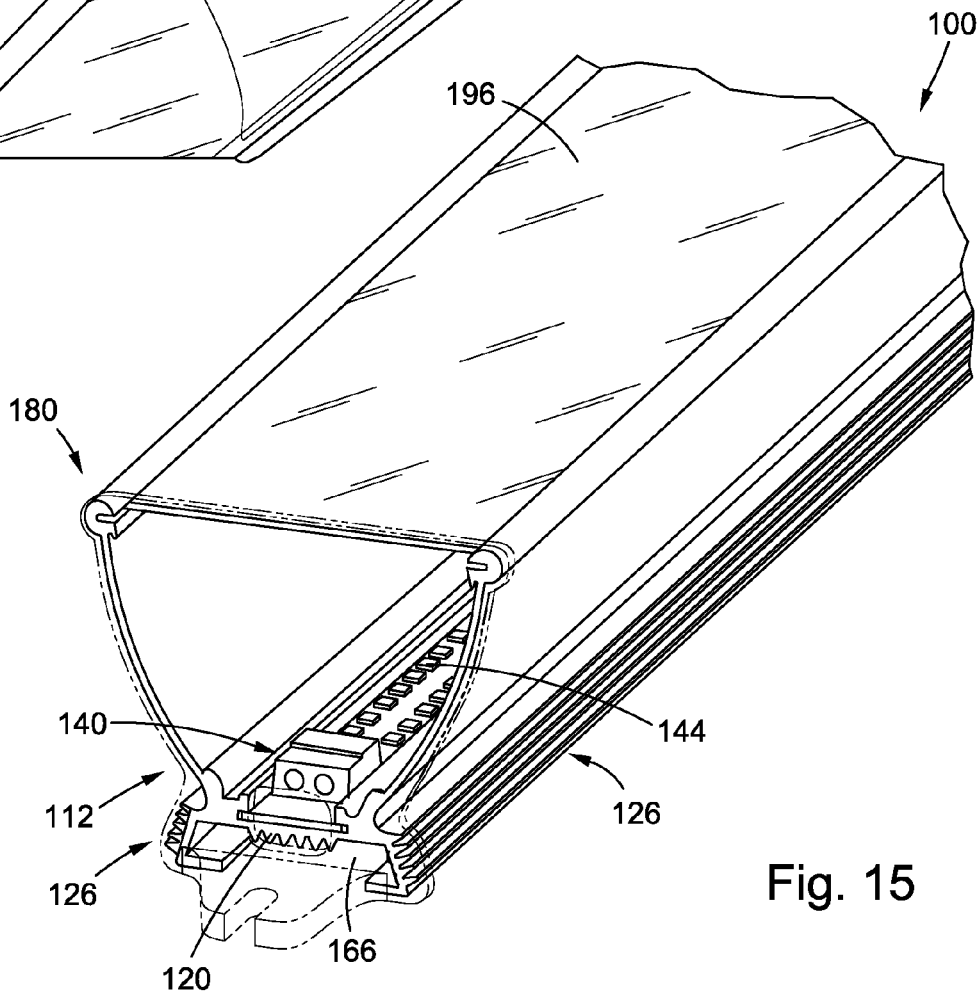
FIG. 15 is an alternative bottom perspective view of the LED high bay light bar constructed in accordance with the second embodiment of the present disclosure.

The LED high bay light bar 100 further comprises an elongate LED strip 140 which is most easily seen in FIGS. 14 and 15. The LED strip 140 preferably comprises an elongate core 142 which has a strip-like configuration and defines opposed, generally planar first and second surfaces. The core 142 is preferably fabricated from aluminum, though alternative materials may be used without departing from the spirit and scope of the present disclosure. Disposed on the first surface of the core 142 is a multiplicity of LEDs 144. The LEDs 144 are disposed on the first surface of the core 142 in a prescribed pattern or arrangement which, as shown in FIG. 15, comprises two side-by-side, generally parallel rows thereof. Those of ordinary skill in the art will recognize that the number and arrangement of LEDs 144 disposed on the first surface of the core 142 in the LED strip 140 integrated into the LED high bay light bar 100 may be varied depending on the size/length and contemplated application for the LED high bay light bar 100.

In the LED high bay light bar 100, it is contemplated that the LED strip 140, and in particular the core 142 thereof, will be mechanically bonded to the first surface 116 of the support portion 114 of the channel member 112. In greater detail, subsequent to the placement of the second surface of the LED strip 140 upon the support portion 114 and extension of the LED strip 140 along the first surface 116 thereof, each of the coupling arm segments 124 of the channel member 112 will be bent slightly downwardly from the relative orientations shown in FIG. 17 so as to mechanically abut or engage the LED strip 140. In greater detail, the size and position of the LED strip 140 relative to the size and position of the coupling arm segments 124 results in the bent coupling arm segments 124 engaging corresponding portions of the first surface of the core 142 which extend along respective ones of the opposed longitudinally extending sides or edges thereof. Thus, by virtue of the abutment of the coupling arm segments 124 against the core 142, the LED strip 140 is effectively mechanically captured between the coupling arm segments 124 and the first surface 116 of the support portion 114. It is contemplated that the length of the LED strip 140, and in particular the core 142 thereof, will be substantially equal to that of the channel member 112, thus resulting in the opposed lateral ends of the core 142 terminating in a substantially flush or continuous relationship with respective ones of the opposed lateral ends of the support portion 114, and in particular the first surface 116 thereof (and hence respective ones of the opposed lateral ends of the channel member 112). When the LED strip 140 is cooperatively engaged to the support portion 114 of the channel member 112 in the aforementioned manner, the core 142 and LEDs 144 disposed thereon are in substantial alignment or registry with the serrated central portion 120 of the second surface 118 of the support portion 114.

Though not shown, it is contemplated that a variant of the channel member 112 may be provided which is analogous the variant 12*a* of the channel member 12 described above and shown in FIG. 10. In this regard, the support portion 114 of the channel member 112 may be provided with the above-described identically configured pair of elongate alignment ribs 46 formed on and extending longitudinally along the first surface 116 in spaced, generally parallel relation to each other. These alignment ribs 46, if included in the channel member 112, would be operative to maintain the LED strip 140 in a prescribed position on the first surface 114, thus assisting in the prevention of any undesirable movement or shifting of the LED strip 140 during the process of bending the coupling arm segments 124 to effectively engage the same.

The LED high bay light bar 100 further preferably comprises an identically configured pair of elongate, generally planar and sheet-like or film-like reflective inserts 196 which are integrated into the reflector portion 180. In greater detail, each of the inserts 196 is sufficiently pliable and sized such that when slightly bent to assume an arcuate profile, portions of each insert 196 extending along each of the opposed longitudinal edges thereof may be slidably advanced into the retention slots 190 of a corresponding pair defined by a respective one of the side sections 182. Thus, when fully advanced into the retention slots 190 defined by a corresponding pair of the retention tabs 188, each of the inserts 196 extends along and covers the majority of the area of the concave interior surface 184 defined by a respective one of the side sections 182. Each insert 196 is preferably fabricated from a material providing ultra-high reflectivity, and preferably one which reflects about 98% of the light applied thereto.

Figure 18:
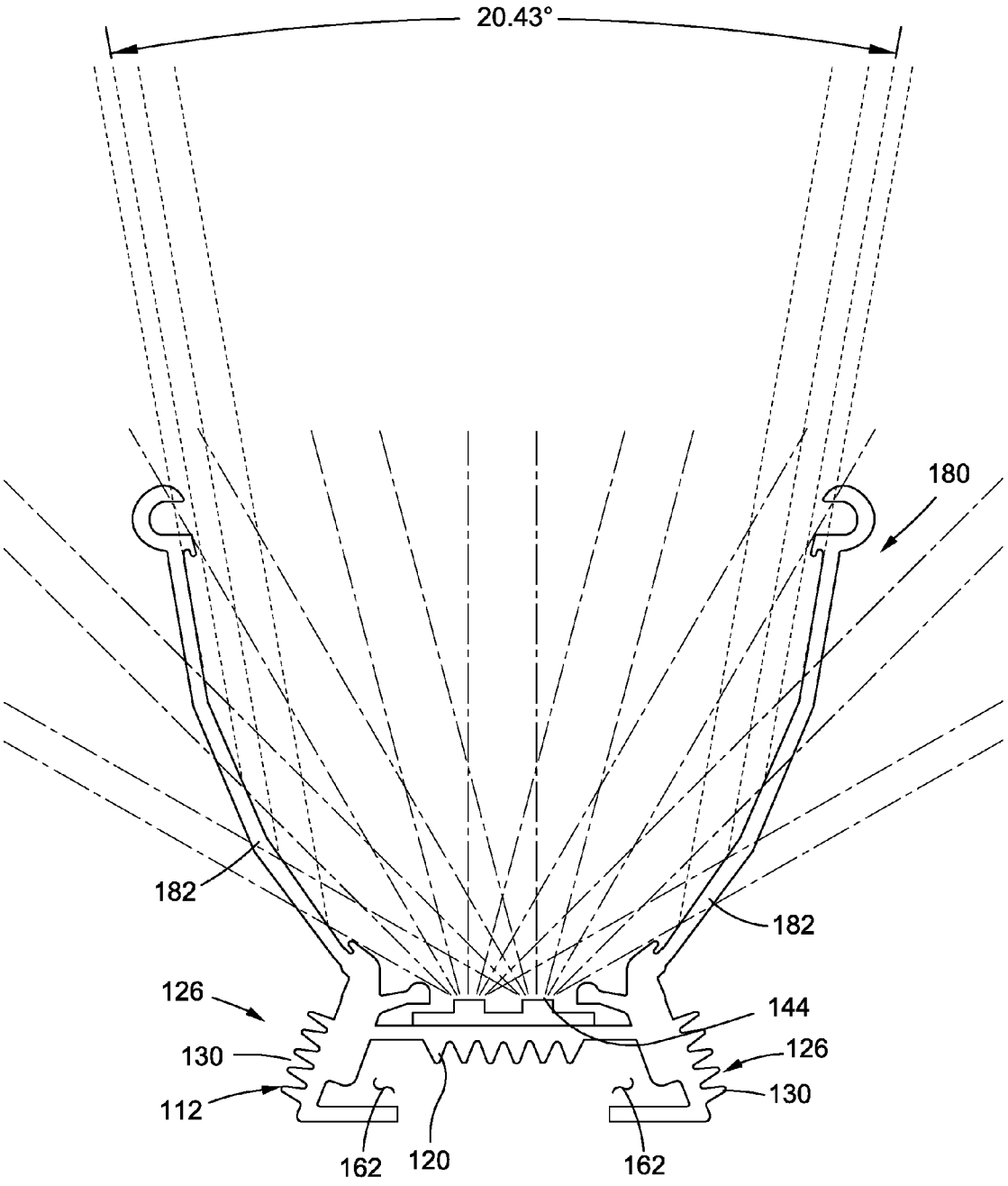
FIG. 18 is a cross-sectional view of the channel member of the LED high bay light bar of the second embodiment similar to FIGS. 16 and 17, but further depicting exemplary light reflection angles facilitated by the structural features of the reflector portion of the channel member.

Referring now to FIG. 18, the structural features/contours of the reflector portion 180, and in particular the side sections 182 thereof are, in concert with the properties of the inserts 196 applied thereto, designed to optimize the amount and consistency of distribution of the light emitted from the LED high bay light bar 100. In an exemplary embodiment, the light distribution optimization properties of the reflector portion 180 are a function of the specific dimensional parameters/relationships as shown in FIG. 16. As indicated above, the objective of the design of the reflector portion 180 is to get as much light as possible as generated by the activation of the LED strip 140 directed from the reflector portion 180, based on contemplated mounting heights of the LED high bay light bar 100 starting at about 20 feet. Along these lines, the distance the side sections 182 are separated from each other, the parabolic shape of the reflector portion 180 collectively defined by the arcuate profiles of the side sections 182, the rate at which the side sections 182 get farther apart as they extend away from the support portion 114, and how far the side sections 182 extend away from the support portion 114 are all optimized to achieve such objective. In this regard, as is apparent from the light beam characterizations included in FIG. 18, the light emitted from the LEDs 144 of the LED strip 140 is both projected directly from the reflector portion 180 and reflected off the inserts 196 extending along the interior surfaces 184 of the side sections 182 of the reflector portion. 180. The curvature of the side sections 182 is optimized to get light out of the reflector portion 180 after only one bounce off of either insert 196, as opposed to reflecting from one side section 182 to the other side section 182, as each bounce of light decreases the light that is able to reach the work surface.

Though not shown, it is completed that the LED high bay light bar 100 may further be outfitted with an elongate, generally planar and sheet-like diffuser which is also integrated into the reflector portion 180. In greater detail, portions of the diffuser extending along each of the opposed longitudinal edges thereof may be slidably advanced into respective ones of the attachments slots 194 defined by the attachments hubs side sections 192. When fully advanced into the attachments slots 194, the diffuser essentially encloses the interior of the reflector portion 180, all of the light emitted from the LEDs 144 thus passing through the diffuser. An exemplary diffuser integrated into the LED high bay light bar 100 is adapted to eliminate glare and evenly distribute light, transmitting about 95% of the generated lumens from the LED strip 140.

Figure 19:
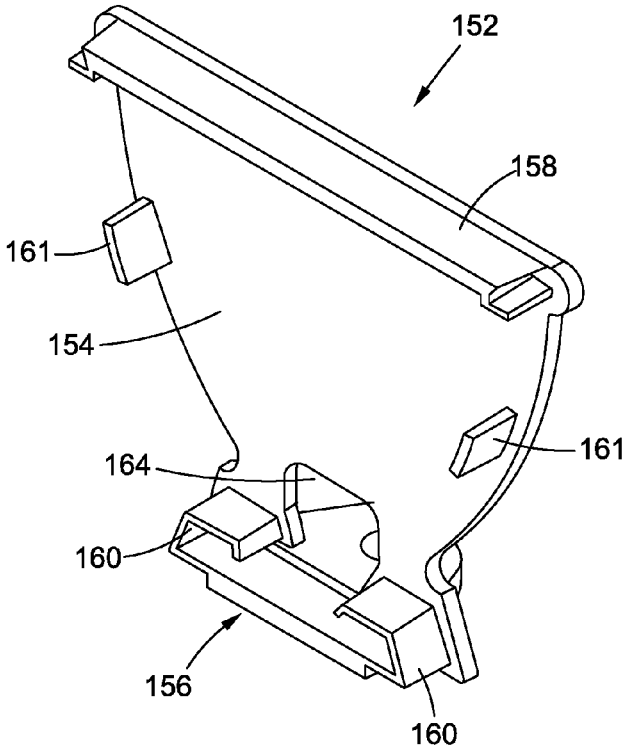
FIG. 19 is a bottom perspective view of one of the identically configured pair of end caps integrated into the LED high bay light bar of the second embodiment.
Figure 20:
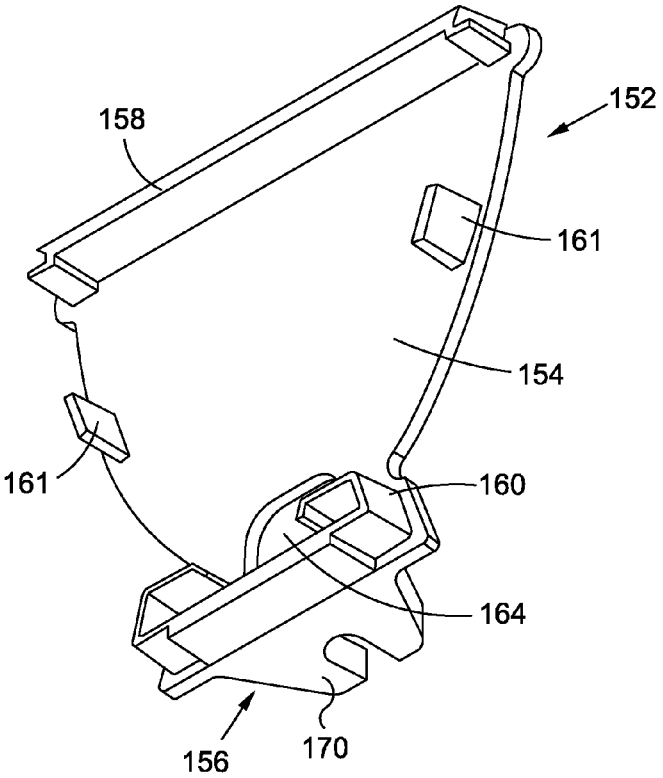
FIG. 20 is a top perspective view of one of the identically configured pair of end caps integrated into the LED high bay light bar of the second embodiment.

Referring now to FIGS. 19 and 20, the LED high bay light bar 100 further comprises an identically configured pairs of end caps 152 which are cooperatively engaged to respective ones of the opposed lateral ends of the channel member 112. Generally speaking, each of the end caps 152 comprises an end wall portion 154 having a base portion 156 integrally formed on and extending along one peripheral side segment thereof, and a flange portion 158 integrally formed on and extending along another peripheral side segment thereof in generally opposed relation to the base portion 156. That segment of the base portion 156 protruding from the end wall portion 154 in the same direction as the flange portion 158 defines an opposed, identically configured pair of engagement tabs 160. Another pair of engagement tabs 161 is formed on the end wall portion 154 in spaced relation to each other and proximate respective ones of opposed peripheral side segments defined by the end wall portion 154, these engagement tabs 161 also extending in the same direction as the flange portion 158.

In the LED high bay light bar 100, the engagement tabs 160 of each end cap 152 are sized and configured to be advanced into and frictionally maintained within respective ones of an opposed pair of recesses 162 which are also defined by the channel member 112. As seen in FIG. 17, each recess 162 is collectively defined by the interior surface 136 of the base arm segment 134 of a corresponding rail portion 126, the interior surface 132 of the heat sink arm segment 128 of that same rail portion 126, and a segment of the second surface 118 of the support portion 114. The advancement of the engagement tabs 160 into the complimentary recesses 162 is limited by the abutment of the corresponding lateral end of the channel member 112 against the end wall portion 154 of the corresponding end cap 152. As the advancement of the engagement tabs 160 of each end cap 152 into the recesses 162 occurs, the opposed lateral end portions of the flange portion 158 of such end cap 152 are simultaneously advanced into respective ones of the attachments slots 194 defined by the attachment hubs 192, the size and shape of the end portions being complimentary to that of the attachments slots 194 as allows the end portions to be frictionally maintained therein. Also, at the same time, the engagement tabs 161 of such end cap 152 are advanced into one open end of the reflector portion 180, and frictionally seated against respective ones of the inserts 196 applied to the interior surface 184 of respective ones of the side sections 182.

Each end cap 152 further defines an opening 164 within the end wall portion 154 thereof. When the end caps 152 are cooperatively engaged to the channel member 112, each opening 164 is aligned and fluidly communicates with an air flow cavity 166 of the channel member 112 which spans the length thereof, and is collectively defined by the second surface 118 of the support portion 114 (including the serrated central portion 120 of the second surface 118), the interior surfaces 132 of the heat sink arm segments 128 of the rail portions 126, and the interior surfaces 136 (as well as the inner ends) of the base arm segments 134 of the rail portions 126. Each opening 164 is further aligned and fluidly communicates with the interior of the reflector portion 180.

In addition to the engagement tabs 160, the base portion 156 of each end cap 152 defines a mounting tab 170 which protrudes from the end wall portion 154 in generally opposed relation to the engagement tabs 160, i.e., in a direction generally opposite the direction the engagement tabs 160, 161 and flange portion 158 protrude from the end wall portion 154. The mounting tabs 170 of the end caps 152 are uniquely configured to facilitate the retrofit attachment of the LED high bay light bar 100 to an underlying support surface, such as a ceiling structure. In this regard, as best seen in FIGS. 19 and 20, each of the mounting tabs 170 defines a central recess which is adapted to accommodate a suitable fastener, such as a screw.

When the LED high bay light bar 100 is attached to an underlying support surface through the use of the mounting tabs 170 of the end caps 152 thereof, it is contemplated that the exterior surfaces 138 of the base arm segments 134 will be abutted against such support surface. As such, with the LED high bay light bar 100 being mounted to such support surface, the air flow cavity 166 is partially enclosed or bounded by the support surface itself which spans across the gap defined between the inner ends of the base arm segments 134.

During operation of the LED high bay light bar 100, the heat generated by the activation of the LEDs 144 is effectively transferred to the core 142 of the LED strip 140. As a result of its direct contact with the first surface 116 of the support portion 114, the core 142 (which is also fabricated from aluminum as indicated above) in turn transfers the heat to the support portion 114 of the channel number 112. Heat transferred from the core 142 to the support portion 114 is in turn effectively dissipated into air within the air flow cavity 166, the heat transfer from the support portion 114 to the air flow cavity 166 being enhanced by the inclusion of the serrated central portion 120 of the second surface 118 which allows the support portion 114 to more effectively function as a heat sink. Heat transferred to the support portion 114 from the core 142 is further transferred to the rail portions 126. Heat transferred to the rail portions 126 is effectively dissipated to ambient air by the serrated surfaces 130 of the heat sink arm segments 128. Thus, the support portion 114 (attributable to its inclusion of the serrated surface 130) and the rail portions 126 (attributable to their inclusion of the serrated surfaces 130 on the heat sink arm segments 128 thereof) effectively define three (3) separate heat sinks within the channel member 112 which allow for the efficient, effective dissipation of heat generated by the LEDs 144 of the LED strip 140. Heat is further dissipated into the open air within the aforementioned cavity 168, further enhancing the efficacy of the LED high bay light bar 100 in dissipating heat. Along these lines, natural air circulation through the air flow cavity 166 and the interior area of the reflector portion 180 as afforded by the openings 164 within the end caps 152 assists in the dissipation of heat from the LED high bay light bar 100. In an exemplary embodiment, the heat dissipation properties of the LED high bay light bar 100 are a function of the specific dimensional parameters of the channel member 112 as also shown in FIG. 16.

Figure 21:
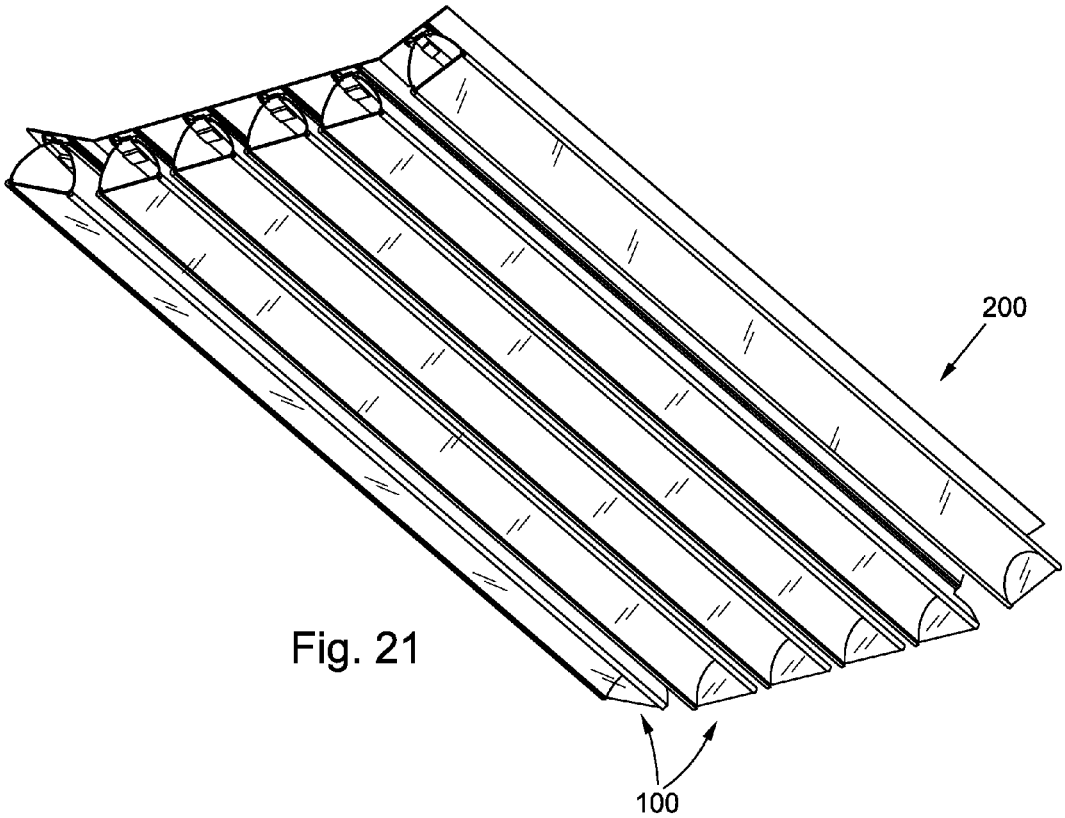
FIG. 21 is a bottom perspective view of an exemplary high bay chassis assembly outfitted with six LED high bay light bars of the second embodiment.
Figure 22:
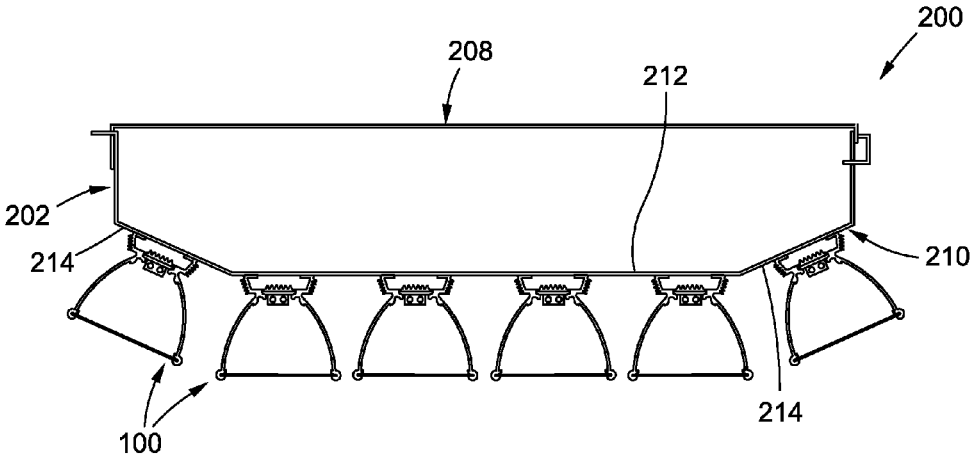
FIG. 22 is a cross-sectional view of the high bay chassis assembly shown in FIG. 21.
Figure 23:
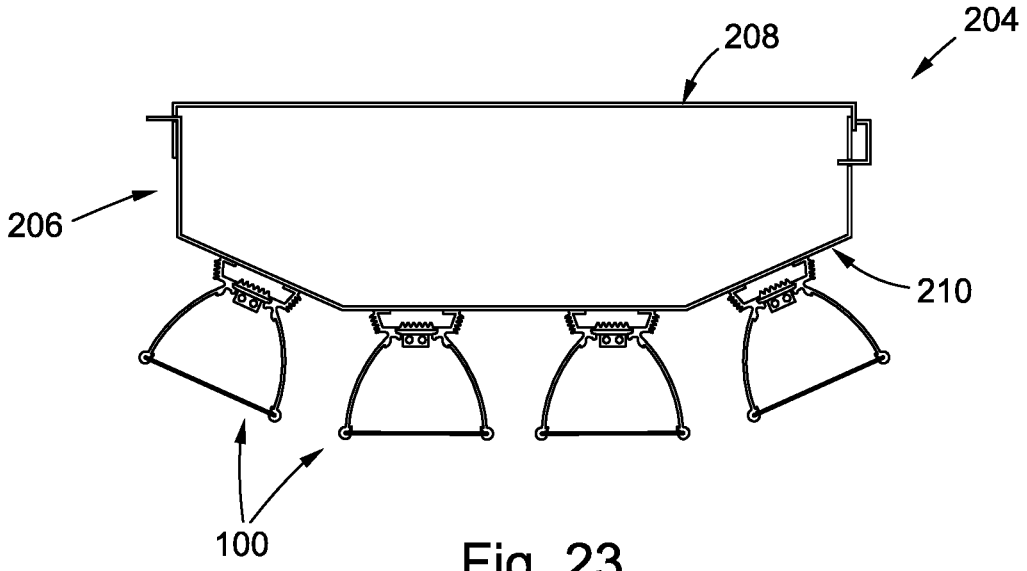
FIG. 23 is a cross-sectional view of an exemplary high bay chassis assembly outfitted with four LED high bay light bars of the second embodiment.
Figure 24:
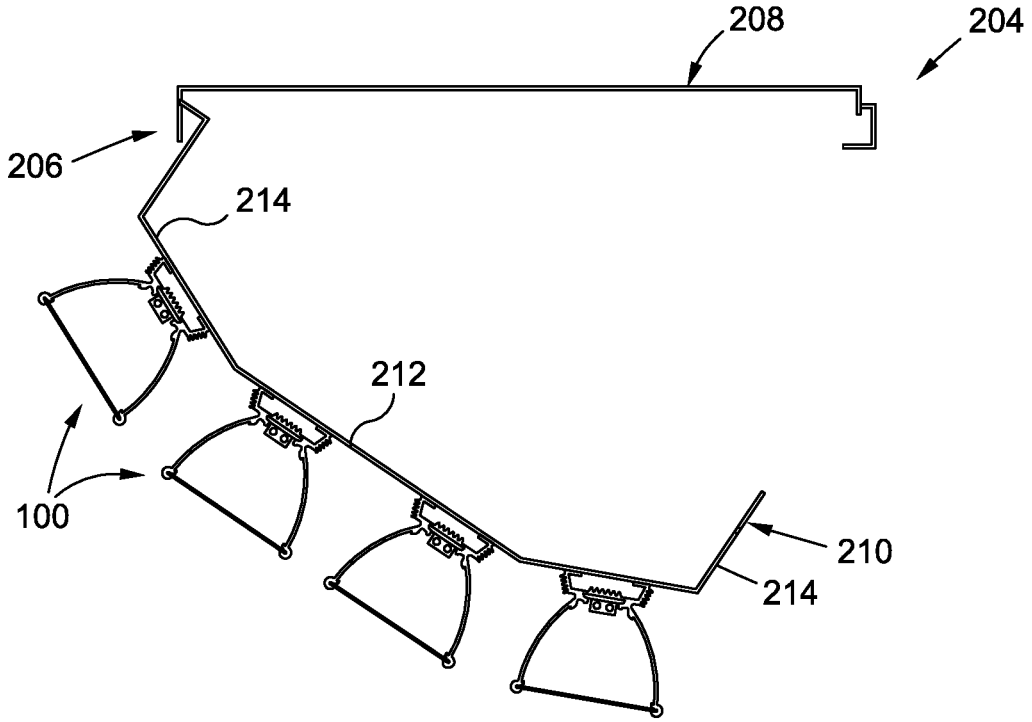
FIG. 24 is a cross-sectional view similar to FIG. 23 but depicting high bay chassis assembly outfitted with four LED high bay light bars of the second embodiment in an open position.

Referring now to FIGS. 21-24, in two exemplary implementations, multiple LED high bay light bars are integrated into a chassis assembly. In FIGS. 21 and 22, a chassis assembly 200 is depicted wherein six (6) LED high bay lights bars 100 are attached to a common chassis or housing 202, In FIGS. 23 and 24, a chassis assembly 204 is depicted wherein four (4) LED high bay lights bars 100 are attached to a common chassis or housing 206. Each housing 202, 206 preferably has a two-piece construction, including a first section 208 and a second section 210 which is pivotally connected to the first section 208 and movable between a closed position (as shown in FIGS. 22 and 23) and an open position (as shown in FIG. 24) relative thereto. The movement of the second section 210 to the open position allows for easy access to the interior of the housing 202, 206 which accommodates various components (e.g., drivers) related to the functionality of the corresponding chassis assembly 200, 204.

Within each housing 202, 206, the second section 210 includes a generally planar central portion 212, and a pair of generally planar side potions 214 which extend along and at prescribed angles relative to respective ones of the opposed longitudinal sides of the central portion 212. In the chassis assembly 200, four (4) LED high bay light bars 100 are attached to and extend along the exterior surface of the central portion 212 in side-by-side, spaced, generally parallel relation to each other, with two (2) more LED high bay light bars 100 being attached to the exterior surfaces of respective ones of the side portions 214 so as to extend in spaced, generally parallel relation to those LED high bay light bars 100 attached to the central portion. Similarly, in the chassis assembly 204, two (2) LED high bay light bars 100 are attached to and extend along the exterior surface of the central portion 212 in side-by-side, spaced, generally parallel relation to each other, with two (2) more LED high bay light bars 100 being attached to the exterior surfaces of respective ones of the side portions 214 so as to extend in spaced, generally parallel relation to those LED high bay light bars 100 attached to the central portion. Thus, the sole distinction in the housings 202, 206 lies in the widths of the first section 208 and the central portion 212 of the second section 212 in the housing 202 exceeding those of the housing 206.

Figure 25A:
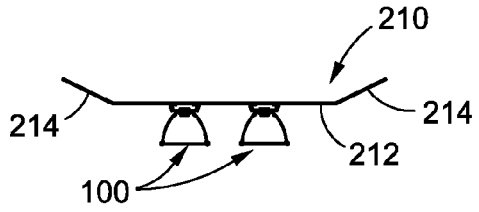
FIGS. 25A-25H depict exemplary variations of high bay chassis assemblies outfitted with differing numbers of LED high bay light bars of the second embodiment in either compact or wide configurations.
Figure 25B:
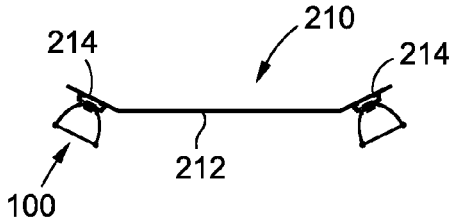

FIGS. 25A-25H depict other exemplary chassis assembly implementations wherein two (2) or more LED high bay light bars 100 are attached to the second section 210 in any one of a multiplicity of different arrangements. in the depicted examples, the second section 210 may be part of the housing 202, the housing 206, or one wherein the first and second sections 208, 210 have dimensions from those included in the housings 202, 206. In greater detail FIG. 25A shows a "two narrow" implementation wherein two (2) LED high bay lights bars 100 are attached to the central portion 212 of the second section 210 in spaced, generally parallel relation to each other, no LED high bay lights bars 100 being attached to the side portions 214. FIG. 25B shows a "two wide" implementation wherein two (2) LED high bay lights bars 100 are attached to respective ones of the side portions 214 of the second section 210, no LED high bay lights bars 100 being attached to the central portion 212.

Figure 25C:
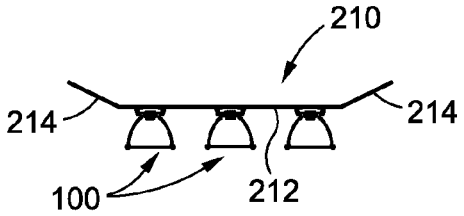
Figure 25D:
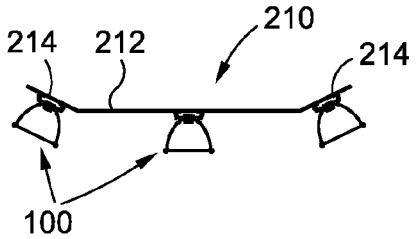

FIG. 25C shows a "three narrow" implementation wherein three (3) LED high bay lights bars 100 are attached to the central portion 212 of the second section 210 in spaced, generally parallel relation to each other, no LED high bay lights bars 100 being attached to the side portions 214. FIG. 25D shows a "three wide" implementation wherein two (2) LED high bay lights bars 100 are attached to respective ones of the side portions 214 of the second section 210, with one (1) LED high bay lights bar 100 being attached to the central portion 212 and extending in generally parallel relation to the other two.

Figure 25E:
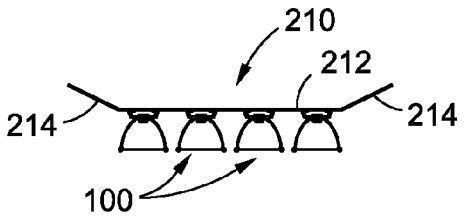
Figure 25F:
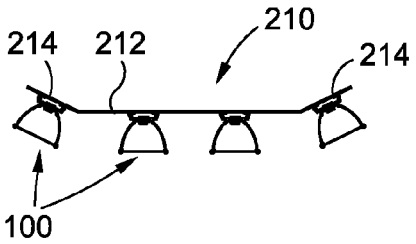

FIG. 25E shows a "four narrow" implementation wherein four (4) LED high bay lights bars 100 are attached to the central portion 212 of the second section 210 in spaced, generally parallel relation to each other, no LED high bay lights bars 100 being attached to the side portions 214. FIG. 25F shows a "four wide" implementation (similar to the chassis assembly 204 shown in FIGS. 23 and 24) wherein two (2) LED high bay lights bars 100 are attached to respective ones of the side portions 214 of the second section 210, with two (2) LED high bay lights bars 100 being attached to the central portion 212 and extending in generally parallel relation to each other and the other two.

Figure 25G:
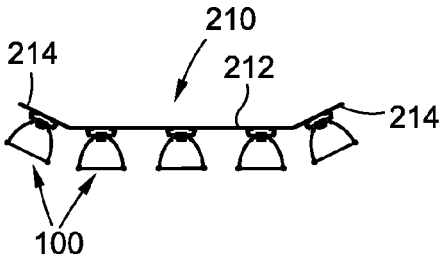
Figure 25H:
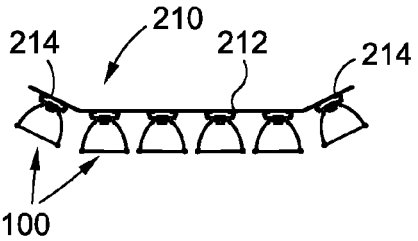

FIG. 25G shows a "five bar" implementation wherein three (3) LED high bay lights bars 100 are attached to the central portion 212 of the second section 210 in spaced, generally parallel relation to each other, and an additional two (2) LED high bay lights bars 100 are attached to respective ones of the side portions 214 of the second section 210 so as to extend in generally parallel relation to the other three. Finally, FIG. 25H shows a "six bar" implementation (similar to the chassis assembly 200 shown in FIGS. 21 and 22) wherein four (4) LED high bay lights bars 100 are attached to the central portion 212 of the second section 210 in spaced, generally parallel relation to each other, and an additional two (2) LED high bay lights bars 100 are attached to respective ones of the side portions 214 of the second section 210 so as to extend in generally parallel relation to the other four, It is further contemplated that rather than being attached to a customized housing such as the housing 202, 206, one or more LED high bay light bars 100 (or even one or more of the above-described LED light bars 10) may be retrofit the housing of an existing fluorescent fixture. In an exemplary retrofit method to an existing fluorescent fixture, the reflector and ballast are removed from the existing housing, with the ballast being replaced by a suitable LED driver. Thereafter, a retrofit plate is attached to the existing housing in substitution for the reflector, with one or more LED high bay light bars 100 or one or more of the above-described LED light bars 10 then being attached to the retrofit plate and operatively coupled to the driver.

This disclosure provides exemplary embodiments of the present disclosure. The scope of the present disclosure is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An LED high bay light bar, comprising:

an elongate channel member defining:

an elongate support portion which defines a first surface and an opposed second surface, at least a portion of the second surface having a serrated configuration of increased surface area;

an identically configured pair of elongate coupling arm segments which at least partially overhang the first surface of the support portion;

a generally parabolic reflector portion which protrudes from the first surface of the support portion; and an identically configured pair of elongate rail portions integrally connected to and extending along support portion in opposed relation to each other, each of the rail portions defining a heat sink arm segment having an exteriorly presented serrated surface and a base arm segment which configured to be abutted against an underlying support surface;

an LED strip attached to and the channel member and extending along at least portion of the first surface of support portion thereof, the LED strip being maintained in engagement to the support portion by the coupling arm segments;

wherein the channel member is configured such that the second surface of the support portion is separated from the base arm segments of the rail portions by a distance sufficient to facilitate the formation of a heat dissipating airflow cavity between the second surface and the support surface when the base arm segments are abutted against the support surface, and the reflector portion is configured optimize light distribution.

2. The LED high bay light bar of claim 1 wherein the reflector portion comprises an identically configured pair of arcuate side sections which protrude from the first surface of the support portion in opposed relation to each other, each of the side sections defining a generally concave interior surface, with the interior surfaces being sized and configured that light emitted from the LED strip will bounce therefrom no more than once prior to exiting the reflector portion.

3. The LED high bay light bar of claim 2 further comprising a sheet like reflective insert applied to the interior surface of each of the side sections of the reflector portion.

4. The LED high bay light bar of claim 2 further comprising a diffuser cooperatively engaged to the reflector portion in a manner effectively covering the LED strip.

5. The LED high bay light bar of claim 1 further comprising an identically configured pair of end caps attached to respective ones of an opposed pair of ends defined by the channel member.

6. The LED high bay light bar of claim 5 wherein each of the end caps defines an attachment tab portion adapted to facilitate the attached of the LED high bay light bar to the support surface.

7. An LED high bay light bar, comprising:

an elongate channel member defining:

an elongate support portion which defines a first surface and an opposed second surface, at least a portion of the second surface having a serrated configuration of increased surface area;

a reflector portion which protrudes from the first surface of the support portion and includes an identically configured pair of arcuate side sections which protrude from the first surface of the support portion in opposed relation to each other, each of the side sections defining a generally concave interior surface; and an identically configured pair of elongate rail portions integrally connected to and extending along support portion in opposed relation to each other, each of the rail portions defining a heat sink arm segment having an exteriorly presented serrated surface and a base arm segment which configured to be abutted against an underlying support surface;

an LED strip attached to and the channel member and extending along at least portion of the first surface of support portion thereof;

wherein the channel member is configured such that the second surface of the support portion is separated from the base arm segments of the rail portions by a distance sufficient to facilitate the formation of a heat dissipating air flow cavity between the second surface and the support surface when the base arm segments are abutted against the support surface, and the interior surfaces of the reflector portion are sized and configured such that light emitted from the LED strip will bounce therefrom no more than once prior to exiting the reflector portion so as to optimize light distribution therefrom.

8. The LED high bay light bar of claim 7 wherein the channel member further comprises an identically configured pair of elongate coupling arm segments which at least partially overhang the first surface of the support portion, the LED strip being maintained in engagement to the support portion by the coupling arm segments.

9. The LED high bay light bar of claim 7 further comprising a sheet like reflective insert applied to the interior surface of each of the side sections of the reflector portion.

10. The LED high bay light bar of claim 7 further comprising a diffuser cooperatively engaged to the reflector portion in a manner effectively covering the LED strip.

11. The LED high bay light bar of claim 7 further comprising an identically configured pair of end caps attached to respective ones of an opposed pair of ends defined by the channel member.

12. The LED high bay light bar of claim 11 wherein each of the end caps defines an attachment tab portion adapted to facilitate the attached of the LED high bay light bar to the support surface.

13. An LED high bay light bar, comprising:

an elongate channel member defining:

an elongate support portion which defines a first surface and an opposed second surface;

a reflector portion which protrudes from the first surface of the support portion and includes an identically configured pair of arcuate side sections which protrude from the first surface of the support portion in opposed relation to each other, each of the side sections defining a generally concave interior surface; and an identically configured pair of elongate rail portions connected to and extending along support portion in opposed relation to each other, each of the rail portions defining a heat sink arm segment having an exteriorly presented surface and a base arm segment which configured to be abutted against an underlying support surface;

an LED strip attached to and the channel member and extending along at least portion of the first surface of support portion thereof;

wherein the channel member is configured such that the second surface of the support portion is separated from the base arm segments of the rail portions by a distance sufficient to facilitate the formation of a heat dissipating air flow cavity between the second surface and the support surface when the base arm segments are abutted against the support surface, and the interior surfaces of the reflector portion are sized and configured such that light emitted from the LED strip will bounce therefrom no more than once prior to exiting the reflector portion so as to optimize light distribution therefrom.

14. The LED high bay light bar of claim 13 wherein the channel member further comprises an identically configured pair of elongate coupling arm segments which at least partially overhang the first surface of the support portion, the LED strip being maintained in engagement to the support portion by the coupling arm segments.

15. The LED high bay light bar of claim 13 further comprising a sheet like reflective insert applied to the interior surface of each of the side sections of the reflector portion.

16. The LED high bay light bar of claim 13 further comprising a diffuser cooperatively engaged to the reflector portion in a manner effectively covering the LED strip.

17. The LED high bay light bar of claim 13 further comprising an identically configured pair of end caps attached to respective ones of an opposed pair of ends defined by the channel member.

18. The LED high bay light bar of claim 17 wherein each of the end caps defines an attachment tab portion adapted to facilitate the attached of the LED high bay light bar to the support surface.

19. The LED high bay light bar of claim 13 wherein at least a portion of the second surface of the support portion has a serrated configuration of increased surface area.

20. The LED high bay light bar of claim 13 wherein the exteriorly presented surface of the heat sink arm segment of each of the rail portions is at least partially serrated.

* * * * *